US005309573A

United States Patent [19]

Solar et al.

[11] Patent Number: 5,309,573

[45] Date of Patent: May 10, 1994

[54] INFLATABLE WRIST-STABILIZING SYSTEM

[76] Inventors: Kenneth J. Solar; Roberta E. Solar, both of 3229 Asbury Sq., Dunwoody, Ga. 30346

[21] Appl. No.: 28,776

[22] Filed: Mar. 10, 1993

Related U.S. Application Data

[63] Continuation-in-part of Ser. No. 853,946, Mar. 19, 1992, abandoned.

[51] Int. Cl.[5] ..... A41D 19/00

[52] U.S. Cl. ..... 2/160; 2/161.4; 2/162

[58] Field of Search ..... 2/19, 161 A, 164, 161 R, 2/162, 16, 20, 159, DIG. 3, 169, 160, 413; 273/54 B, 188 R, 166

[56] References Cited

U.S. PATENT DOCUMENTS

| | | | |
|---|---|---|---|
| 562,817 | 6/1896 | Frick et al. | 2/DIG. 3 X |
| 2,041,737 | 5/1936 | Beal | 2/DIG. 3 X |
| 2,154,197 | 4/1939 | Callaway | 273/54 B |
| 2,831,196 | 4/1958 | Scheiber | 273/54 B |
| 3,261,026 | 7/1966 | Joseph | 273/54 B |
| 3,408,077 | 10/1968 | Norwood | 273/54 B |
| 3,423,095 | 1/1969 | Cox | 273/54 B |
| 4,222,569 | 9/1980 | DeMascolo | 273/54 B |
| 4,547,919 | 10/1985 | Wang | 2/413 |
| 5,014,366 | 5/1991 | Discipio, Sr. | 2/413 |
| 5,123,119 | 6/1992 | Dube | 2/169 X |
| 5,170,508 | 12/1992 | Kawada | 2/161 A |
| 5,218,719 | 6/1993 | Johnson | 2/19 |

*Primary Examiner*—Clifford D. Crowder
*Assistant Examiner*—Michael A. Neas
*Attorney, Agent, or Firm*—Dowell & Dowell

[57] ABSTRACT

The wrist-stabilization system includes an inflatable bladder having a plurality of channels in intercommunication one with the other and an inlet for inflating the channels. A glove or a wristband positions the bladder on a user's upper extremity such that substantially equal portions of the channels lie above and below the wrist joint to inhibit wrist joint motion in flexion and extension and assist in maintaining the lateral sides of the hand and forearm in the lateral plane. A manually-actuatable inflation/deflation device is secured to the glove, wristband or bladder and coupled to the bladder whereby the bladder can be manually inflated and deflated.

30 Claims, 15 Drawing Sheets

FIG. 1A
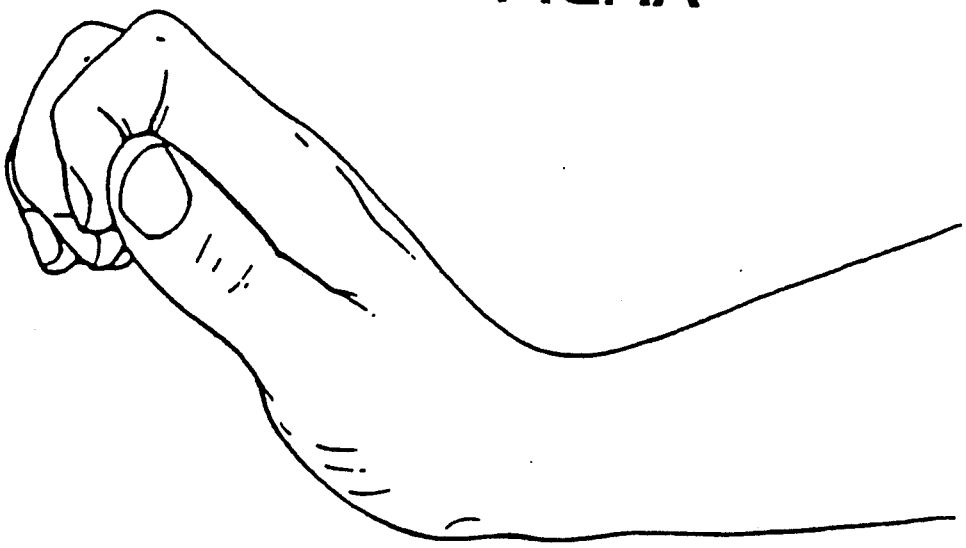
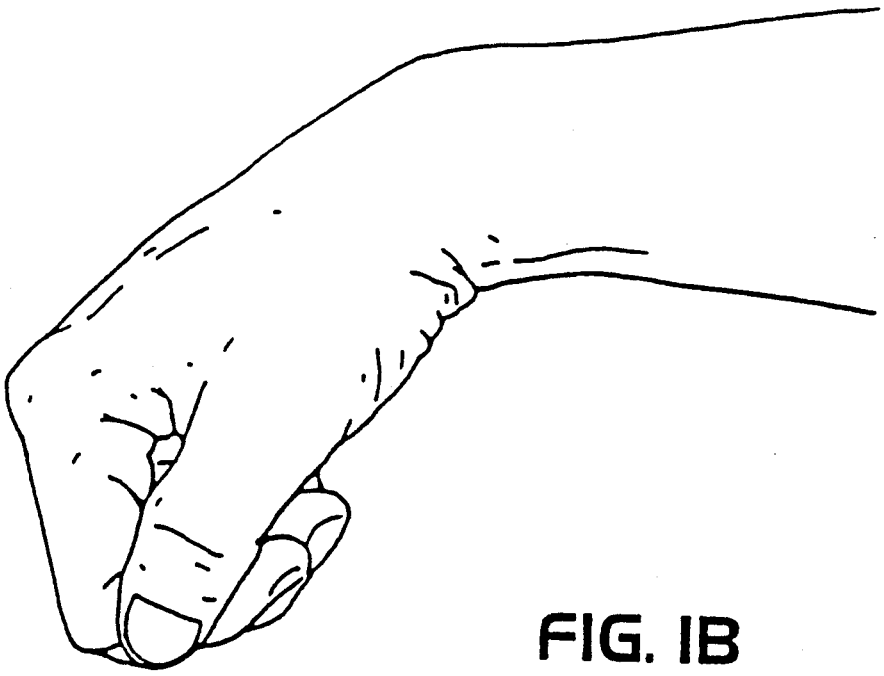
FIG. 1B

INFLATABLE WRIST-STABILIZING SYSTEM

RELATED APPLICATIONS

This application is a continuation-in-part of application Ser. No. 07/853,946, filed March 19, 1992, now abandoned, the disclosure of which is incorporated herein by reference.

TECHNICAL FIELD

The present invention relates to inflatable wrist-stabilization apparatus and methods and particularly to a sports glove, wristband and inflatable bladder for inhibiting wrist joint motion in flexion and extension from a sports-neutral position during sports activity.

BACKGROUND

Many sports can be categorized by the intended use of one or both hands. Hand action in sports, however, cannot be discussed without describing the range of wrist joint motion, stability and flexibility to achieve the desired hand action. It will also be appreciated that two-handed sports, such as golf, baseball, hockey and others, have significantly different wrist and hand position requirements as compared with essentially one-handed sports, such as bowling and horseshoes, and the throwing sports, e.g., baseball and football. Proper hand/wrist action is a requirement in many different sports, whether they are one or two-handed hitting sports or one-handed tossing sports and is a function of the particular requirements for each sport.

The wrist joint, through tendon/muscle interactions in the forearm, allows the hand to move in five directions extension, flexion, abduction, adduction and circumduction. The vertical axis in two-handed hitting sports is referred to by a line formed through the thumb as it points upwardly. The horizontal axis is established 90° to the vertical axis. The control of the speed of motion of the hand along the horizontal axis relative to the forearm is critical in sports that place a premium on directional control, e.g., golf, tennis, baseball batting (known collectively as hitting sports). Many factors are involved to properly strike the ball in each such sport. For example, the shape, speed, size and weight of the ball being struck, as well as the shape of the sport implement used to strike the ball, determine whether the stroke is successful. Upon analysis, however, hitting sports have two very common factors which determine the success or lack of success of properly striking the ball: the rate of speed of the ball at launch and its controlled placement upon launch, i.e., direction of launch. A powerful, well-timed stroke requires extreme athletic skill in hand/wrist action coordination. In hitting sports, such as baseball, where the ball is in motion when struck, hand/eye coordination is essential. Hand-/eye coordination is not as essential in hitting sports where the ball is stationary when struck. In these latter sports, such as in golf, it is desirable to permit the angle of the striking implement surface relative to the horizontal plane to control the launch angle of the ball. Launch trajectory of the ball is controlled by the angle of approach of the hitting surface to the stationary ball. Ball rotation is critical in certain sports to control flight or path along surface, such as bowling. Such rotation may be achieved by rotation of the hand relative to the forearm. For example, polar rotation of the ball toward or away from the thrower occurs as a result of a palm-down or palm-up release position, respectively. A palm-to-the-side hand release position produces a hook or a slice. Thus, controlled wrist movement in extension, flexion, abduction, adduction and circumduction is essential in many sports to achieve desired ball control.

The wrist joint allows the hand to move relative to the forearm by the use of muscles and tendons in the forearm. Ligaments gives the wrist joint stability. The larger the joint area and the greater the range of motion of the extremities attached to the joint, the less effective is the stabilizing value of the ligaments, in contrast to the muscles and tendons. Thus, muscles and tendons become the key components, particularly in sports where substantial immobility of the wrist joint in certain directions is critical to properly strike an object ball. Various types of stabilizers and splints for the different joints of the human anatomy, particularly those used repetitively for sports activity, have been designed to stabilize such joints.

In the case of the wrist joint, the five involved motions in extension, flexion, abduction, adduction and circumduction are limited differently than in other joints. For example, left and right motion of the hand about a vertical axis from an anatomically neutral position is generally limited to about 45°, while abduction and adduction are limited to approximately 5° and 15°, respectively. It will be appreciated that the anatomical neutral position of the hand relative to the forearm has 0° flexion, adduction, abduction and circumduction, and 15° extension. A sports-neutral position, however, for most hitting sports, requires an angle of 0° in all movement directions. In certain sports, for example, golf, it is essential to maintain the sports-neutral position at least in flexion and extension before, on impact, and after impact with the ball. In anatomical terms, the radius and ulna should therefore lie in a plane generally parallel to a plane through the carpals or along the dorsal side of the hand. For a proper impact position in golf, that plane through the leading hand must also be parallel to the leading edge of the club. In two-handed hitting sports such as golf, the hand action or hand release is defined as a change (for a righthanded individual) of the left hand from pronation to supination and a change from supination to pronation by the trailing right hand. Thus, it is essential to maintain the sports-neutral position for the lead hand in flexion and extension, i.e., 0°, throughout the hitting motion. Absent substantial muscle and tendon development, which few obtain in their chosen sport, the necessary control of the hand and wrist action necessary to produce proper repetitive athletic skilled motion is elusive.

DISCLOSURE OF THE INVENTION

The present invention provides a wrist-stabilization system, preferably in the form of a glove, to facilitate control of the wrist joint position, and hence the angle of the hand relative to the forearm, necessary to produce repetitive athletic skilled motion and particularly, through the use of a fluid-inflatable bladder, to effectively stabilize and inhibit wrist joint movement from a position wherein the lateral and dorsal sides of the individual's forearm and hand above and below the wrist joint, respectively, lie substantially in a common lateral plane. That is, the wrist-stabilization apparatus inhibits or restricts movement of the wrist joint from a sports-neutral position of 0° flexion and extension throughout the sport motion. The present invention also affords the foregoing in a wristband separate from, but for use with, a sports glove. Particularly, an inflatable bladder formed of flexible material is provided. The bladder is seamed about its periphery and between its lateral margins to define a plurality of inflatable chambers in free communication with one another. The chambers lie generally parallel to one another, with the seams between the chambers extending longitudinally and being laterally spaced from one another. The bladder has a fluid inlet for receiving an inflating fluid, preferably air, whereby the chambers may be inflated and deflated. While a number of different inflating devices may be used, a standard inflator bulb, with appropriate check and release valves, is preferably employed and permanently or releasably secured to the glove, bladder or wristband, as applicable.

The bladder is sized and configured to overlie lateral side portions of an individual's hand and forearm above and below the wrist joint with the chambers extending in a plane generally parallel to a common lateral plane containing the lateral and dorsal sides of the forearm and hand, respectively, (sports-neutral position of the wrist joint with 0° flexion and extension) and preferably lie equidistant from the lateral centerline of the wrist joint. When the bladder is taut on the lateral and dorsal sides of the forearm and hand above and below the wrist joint, respectively, e.g., by an overlying or underlying glove or other types of coverings, the bladder channels are inflated and provide substantial rigidity. Because the chambers extend linearly and lie in a plane parallel to the plane defined by the radius, ulna and carpals of the wrist joint, the wrist joint is inhibited from movement from its position of 0° flexion and extension. That is to say, the inflated channels exhibit measurable mechanical rigidity at various internal pressures and assist to maintain the wrist joint in a sports-neutral position with respect to flexion and extension. The bladder preferably has its lower wall formed of an elastic material, while the upper wall is formed of a less elastic or non-elastic material. In this manner, increasing inflation pressure affords increasing rigidity of the channels and, hence, improved wrist stabilization without the bladder bulging outwardly into prominence. A controllable profile is obtainable while enabling increasing rigidity with increasing inflation pressure. Further, the bladder is preferably formed of heat-sealable materials, such as thermoplastic materials, such that the seams which define the channels and the peripheral seam about the margins of the bladder may be heat-sealed. While the channels may be individually inflated, preferably the channels lie in open communication with one another for joint inflation by the inflator bulb.

In another form of bladder according to the present invention, an additional channel is provided which extends along the heel side of the hand below the wrist joint and the corresponding side of the forearm above the wrist joint. With this additional channel inflated and affording rigidity, the wrist joint is also inhibited from movement from a sports-neutral position in adduction, e.g., 0° adduction, as well as flexion and extension by the other channels.

In the embodiment hereof wherein the bladder forms part of a wristband separate from a glove, the bladder and inflating mechanism are essentially the same as previously described. However, the wristband enables the user to adjust the position of the bladder over the wrist joint, taking into account anatomical differences of hand/wrist dimensions along the lateral side. A banding is provided along the inner edge of the wristband sufficient to enable securement of the wristband to the forearm. Similarly as in the prior embodiment, where the glove maintaining the bladder taut against the lateral sides of the hand and forearm, the bladder of the wristband must likewise be held taut against the lateral surfaces of the hand and forearm, preferably with substantially equal portions of the channels above and below the wrist joint. This can be accomplished by using a separate overlying glove for pressing the bladder against the lateral surfaces of the hand and forearm. Essentially, the wristband will not migrate if the surface tension between bladder, glove and skin is maintained. Alternatively, the wristband with attached bladder can be releasably secured to an underlying or overlying wrap, preferably a glove, by suitable releasable fasteners, e.g., of the hook-and-loop type. The inflator bulb may be secured directly to the wristband or bladder. In both embodiments of the invention, the chambers may be independently inflatable, if desired, using a separate valving system for each chamber. However, the chambers are preferably in open communication with one another for substantially equal pressurization with only one valving system.

Accordingly, in a preferred embodiment of the present invention, apparatus is provided for inhibiting movement of an individual's wrist joint in flexion and extension from a position wherein the lateral sides of the individual's forearm and hand above and below the wrist joint, respectively, lie substantially in a common lateral plane, the above comprising a covering for at least portions of an individual's hand and forearm and extending along lateral sides thereof above and below the user's wrist joint, a fluid-inflatable wrist-stabilizing means for location along the lateral side of the individual's hand and forearm above and below the individual's wrist joint, means cooperable between the stabilizing means and the covering for maintaining the stabilizing means located along and substantially taut against the lateral sides of the individual's hand and forearm above and below the individual's wrist joint, and means for regulating the fluid volume within the wrist-stabilizing means including means for inflating the wrist-stabilizing means whereby the cover and the inflated wrist-stabilizing means cooperate to substantially inhibit movement of the wrist joint in flexion and extension from a position wherein the lateral sides of the individual's forearm and hand above and below the wrist joint, respectively, lie substantially in a common lateral plane.

In another embodiment of the present invention, apparatus is provided for inhibiting movement of an individual's wrist joint in flexion and extension from a position wherein the lateral sides of the individual's forearm and hand above and below the wrist joint, respectively, lie substantially in a common lateral plane, comprising a wristband for extending about an extremity of an individual adjacent the individual's wrist joint and securement to the individual's extremity, a fluid-inflatable wrist-stabilizing means carried by the wristband for location along lateral sides of the individual's hand and forearm above and below the individual's wrist joint when the wristband is secured to the individual's extremity, the wrist-stabilizing means including an inflatable bladder having a plurality of inflatable channels extending generally parallel to the forearm and with substantially equal portions of the channels lying above and below a lateral centerline through the wrist joint along the lateral sides of the hand and forearm, and means for regulating the fluid volume within the wrist-stabilizing means including means for inflating the channels, the bladder having passages providing open communication between the channels and a fluid inlet connected to the inflating means for receiving fluid for inflating the channels, portions of the channels being formed of an elastic material, whereby, upon inflation of the channels, the inflated wrist-stabilizing means is adapted to substantially inhibit movement of the individual's wrist joint in flexion and extension from the position wherein the lateral sides of the individual's forearm and hand above and below the wrist joint, respectively, lie substantially in a common lateral plane.

In another embodiment of the present invention, apparatus is provided for inhibiting movement of an individual's wrist joint in flexion and extension from a position wherein the lateral sides of the individual's forearm and hand above and below the wrist joint, respectively, lie substantially in a common lateral plane, comprising a fluid-inflatable wrist-stabilizing means for location along lateral sides of the individual's hand and forearm above and below the individual's wrist joint, the wrist-stabilizing means including an inflatable bladder having upper and lower walls defining a plurality of inflatable channels therebetween for extending generally parallel to the forearm and with substantially equal portions of the channels lying above and below a lateral centerline through the wrist joint along the lateral sides of the hand and forearm, the channels being formed by interior seams extending parallel to the channels and laterally spaced from one another and a perimeter seal about the bladder, the seams including heat-sealed portions of the upper and lower walls, the interior seams being spaced at least at one end from the perimeter seam to define fluid communication passages for flow of fluid between adjacent channels and means for regulating fluid volume within the wrist-stabilizing means including means for inflating the channels, the bladder having passages providing open communication between the channels and a fluid inlet connected to the inflating means for receiving fluid for inflating the channels, portions of the channels being formed of an elastic material, whereby, upon inflation of the channels and location along the wrist joint, the inflated wrist-stabilizing means is adapted to substantially inhibit movement of the individual's wrist joint in flexion and extension from the position wherein the lateral sides of the individual's forearm and hand above and below the wrist joint, respectively, lie substantially in a common lateral plane.

In a further embodiment of the present invention, a method for inhibiting movement of an individual's wrist joint in flexion and extension from a position wherein the lateral sides of the individual's forearm and hand above and below the wrist joint, respectively, lie substantially in a common lateral plane is provided, comprising the steps of overlying portions of an individual's forearm and hand along lateral sides thereof above and below the individual's wrist joint, respectively, with a fluid-inflatable bladder having a plurality of inflatable channels extending generally parallel to the individual's forearm with substantially equal portions of the channels lying above and below a lateral centerline through the individual's wrist joint, inflating the channels, and rendering the inflated bladder taut along the lateral sides of the individual's hand and forearm such that the bladder channels exert forces to inhibit movement of the individual's wrist joint from a position wherein the lateral sides of the individual's forearm and hand above and below the wrist joint, respectively, lie substantially in a common lateral plane.

Accordingly, it is a primary object of the present invention to provide a novel and improved inflatable wrist-stabilization system for applying pressure and forces along the wrist joint to stabilize the wrist joint against movement in flexion and extension, and, optionally, adduction from a sports-neutral position.

BRIEF DESCRIPTION OF THE DRAWINGS

FIGS. 1A–1D are schematic illustrations illustrating the wrist joint of an individual and identifying the motions thereof in extension, flexion, adduction and abduction, respectively;

BEST MODE FOR CARRYING OUT THE INVENTION

Reference will now be made in detail to a present preferred embodiment of the invention, an example of which is illustrated in the accompanying drawings.

Figure 1C:
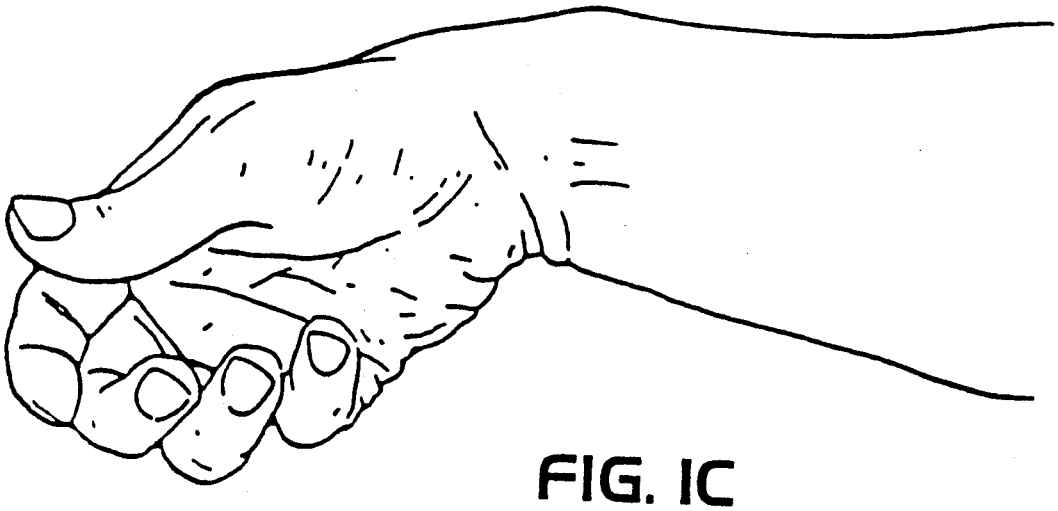
Figure 1D:
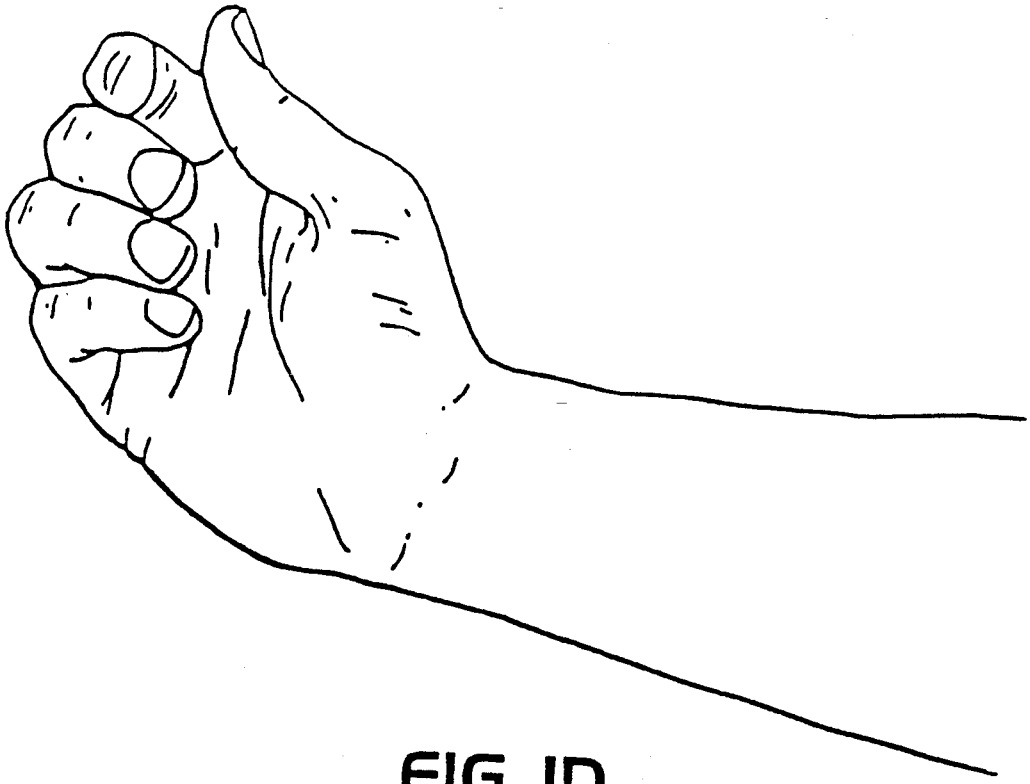
Figure 1E:
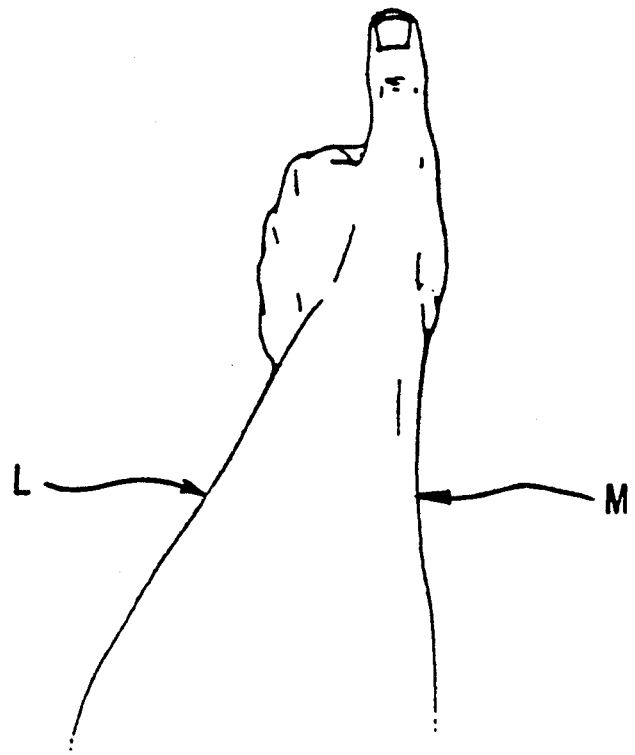
FIG. 1E is a top view of an individual's left hand and forearm with the wrist in a sports-neutral position.
Figure 1F:
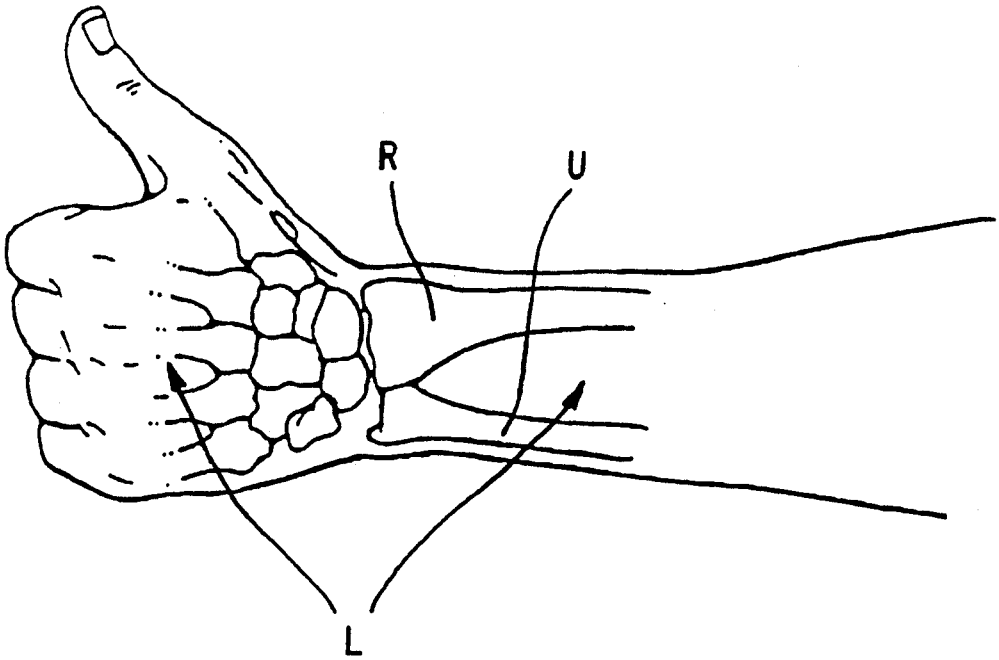
FIG. 1F is a side view of the hand and forearm illustrated in FIG. 1E as viewed from the lateral side.

Referring now to drawing FIGS. 1A–1D, the motions of the wrist in extension, flexion, adduction and abduction are illustrated, respectively. With respect to FIGS. 1A and 1B illustrating extension and flexion, if the forearm is in a horizontal plane, extension is wrist motion tending to elevate the hand relative to the forearm, and flexion is wrist motion tending to depress the hand relative to the plane of the forearm. With the forearm rotated 90° into a vertical plane, adduction is the wrist motion depressing the hand relative to the forearm in the vertical plane and toward the ground or, uncocking. Abduction is elevating the hand relative to the forearm in the vertical plane, i.e., wrist cocking. Circumduction is, of course, rotation of the forearm, wrist and hand. The lateral side of the hand and forearm is shown in FIG. 1E along "L" and the medial side along "M".

For definitional purposes, the anatomical centerline of the wrist is the juncture of the lower end of the radius "r" and ulna "U" and the carpals, i.e., the scaphoid, semilunar and cuneiform bones which form the condyle. The lateral wrist centerline for extension and flexion for present purposes may be defined also as the skin fold created by the hand and forearm when in the anatomical neutral position, e.g., with 15° extension. Additionally, the sports-neutral position of the wrist joint in flexion and extension may be defined as the position of the wrist joint wherein the lateral and dorsal sides of the forearm and hand above and below the wrist joint, respectively, lie substantially in a common lateral plane, i.e., the wrist joint lies at substantially 0° in flexion and extension relative to the forearm. As used herein, the term "lateral" refers to the face of an extremity, e.g., an arm and hand, spaced the furthest away from the medial plane of the body as compared with other surfaces of that extremity. With respect to the forearm and hand, "lateral" means the lateral side of the forearm and the dorsal or back side of the hand.

Figure 2:
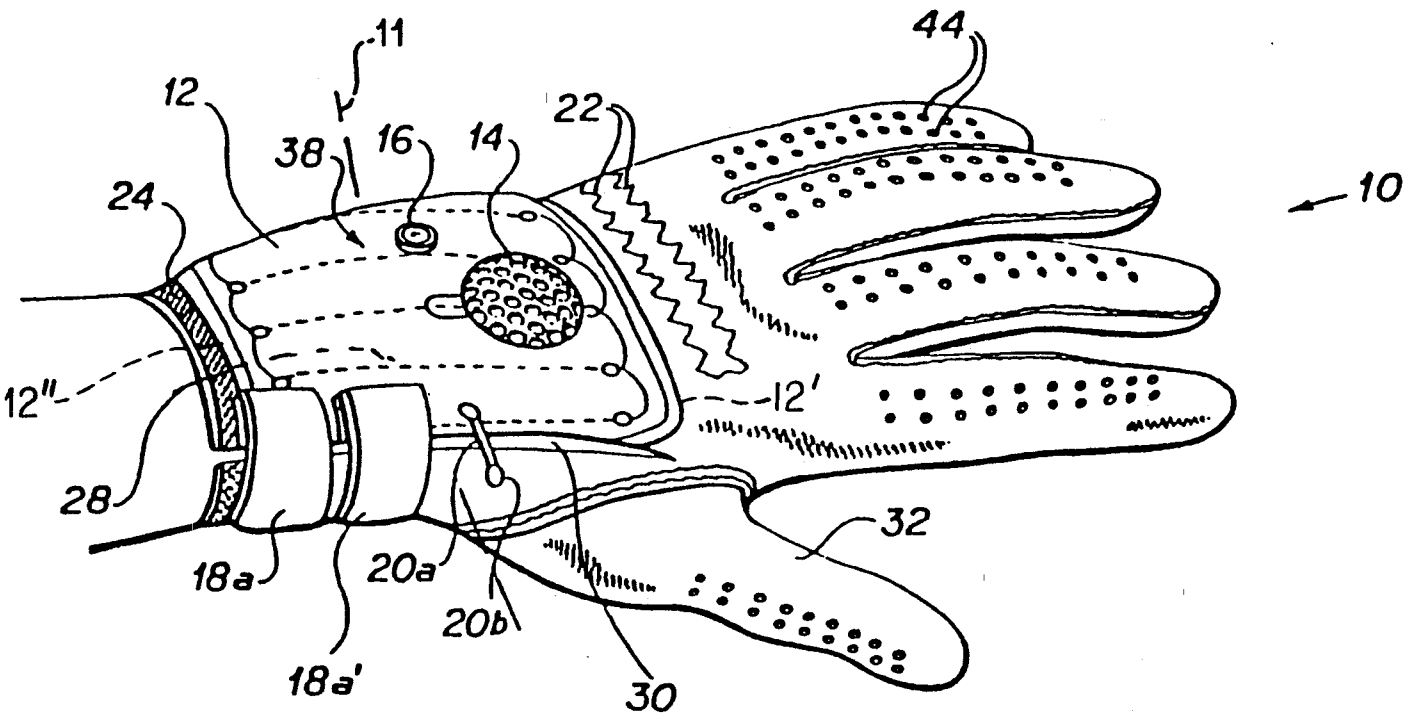
FIG. 2 is a perspective view of a wrist-stabilization system in accordance with a first embodiment of the present invention.

Turning now to FIG. 2, there is illustrated in FIG. 1 a wrist-stabilization system according to the present invention in the form of a glove 10, preferably a golf glove. The glove 10 is provided with a mechanism for stabilizing undesirable hinging, or bending, motion of the wrist joint. Particularly, the system inhibits wrist joint motion from a sports-neutral position of 0° flexion and extension during sports activity. That is, glove 10 inhibits movement of an individual's wrist joint in flexion and extension from a position wherein the lateral sides of the individual's forearm and hand above and below the wrist joint, respectively, lie substantially in a common lateral plane. Wrist joint motion in adduction can also be inhibited in accordance with the present invention, as discussed hereafter.

Figure 4:
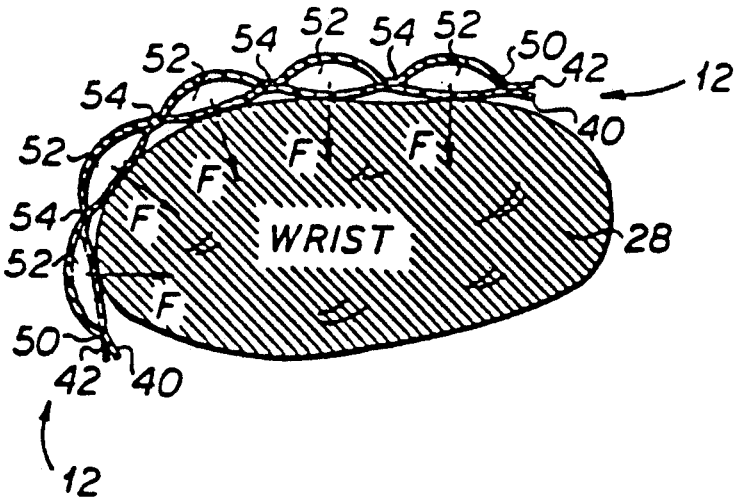
FIG. 4 is an enlarged, partial, cross sectional view of the glove of FIG. 4 on the user wrist taken along line 4'–4''.
Figure 16:
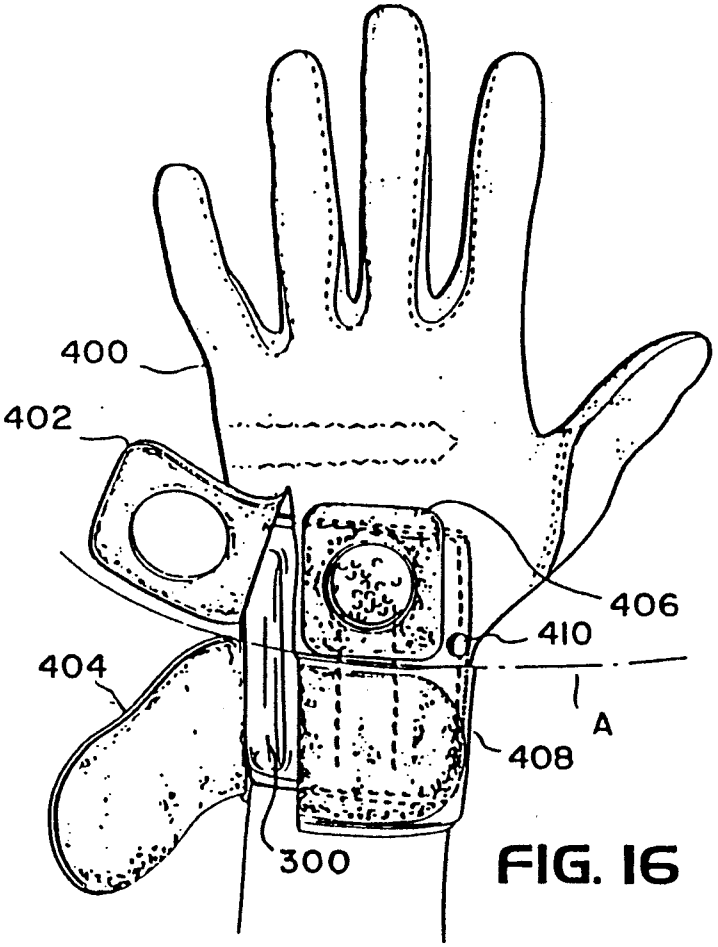
FIG. 16 is a knuckle-side plan view of a wrist-stabilizing system in accordance with a still further embodiment of the present invention.
Figure 18:
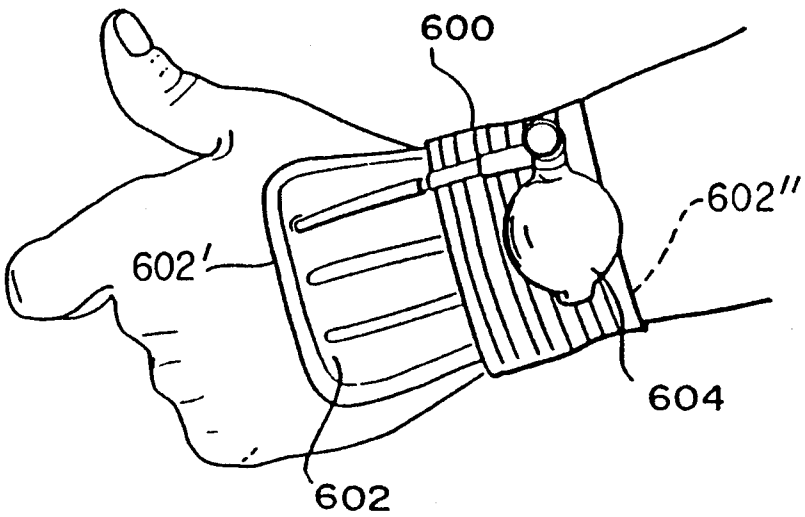
FIG. 18 is a knuckle-side view of a wristband and bladder forming a further embodiment of a wrist-stabilization system.
Figure 17:
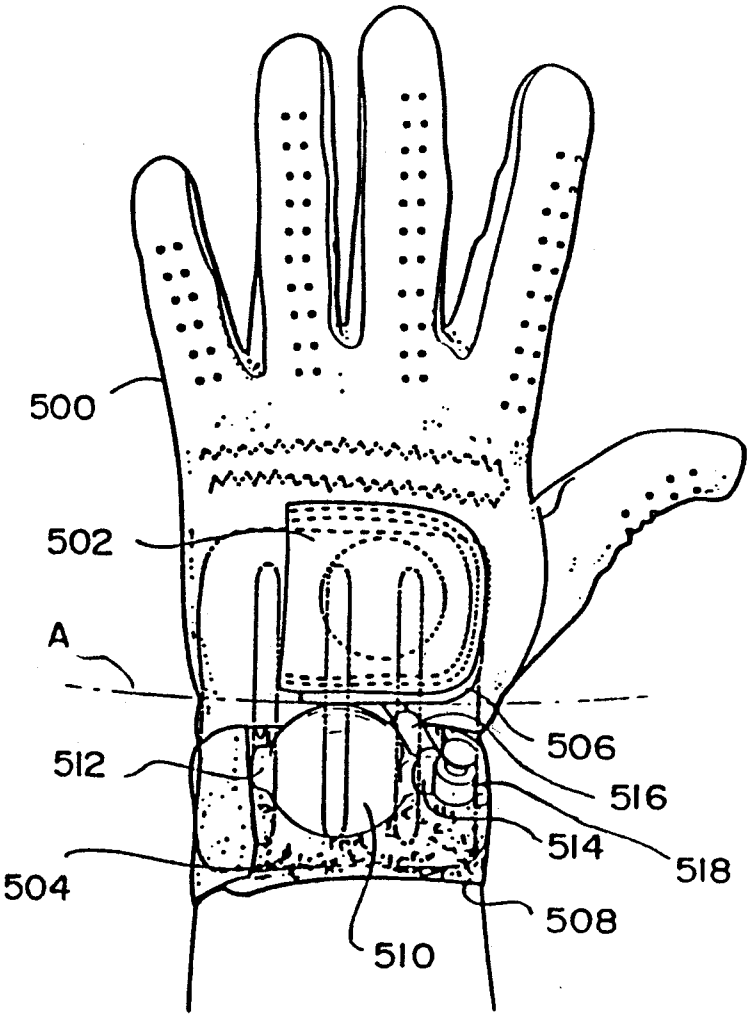
FIG. 17 is a view similar to FIG. 15 illustrating a still further embodiment.

Glove 10 includes a covering manufactured from any suitable flexible material, e.g., real or synthetic leather, vinyl, or similar soft, pliable, resilient material. A flexible bladder 12, which may be inflated with fluid, e.g, air, by using a suitable air pump 14, is provided within glove 10 for use in conjunction with glove 10, in stabilizing a user's wrist joint 28 about its lateral centerline designated A in FIG. 2 and to aid in inhibiting unwanted wrist joint motion. The volume of air within the air bladder 12 is regulated by the air pump 14 and a pneumatic air release valve 16. As is shown in FIG. 2, the bladder is positioned along the lateral side "L" of the hand spaced from the base of the thumb and includes a leading edge 12' and a rear edge 12". The trailing edge terminates in spaced relationship to the knuckles along the lateral "L" side of the hand and the rear edge extends along the forearm above the wrist. In some embodiments, the bladder may extend to the heal of the hand, as shown in FIG. 4, in other embodiments the bladder only extends along the lateral side of the hand, as shown in FIGS. 16–18.

Figure 2A:
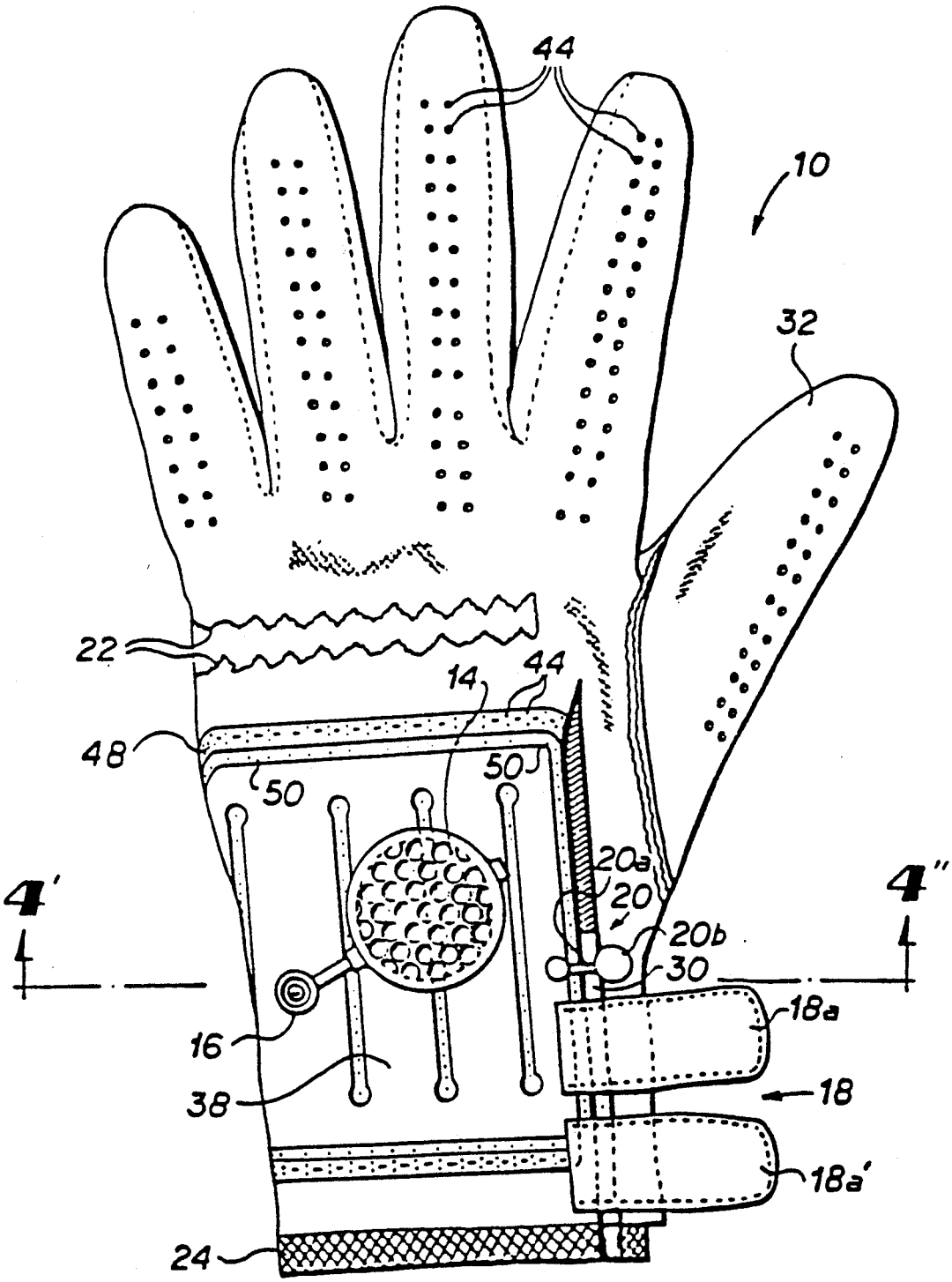
FIG. 2A is a lateral or knuckle-side plan view of the system of FIG. 2.
Figure 2B:
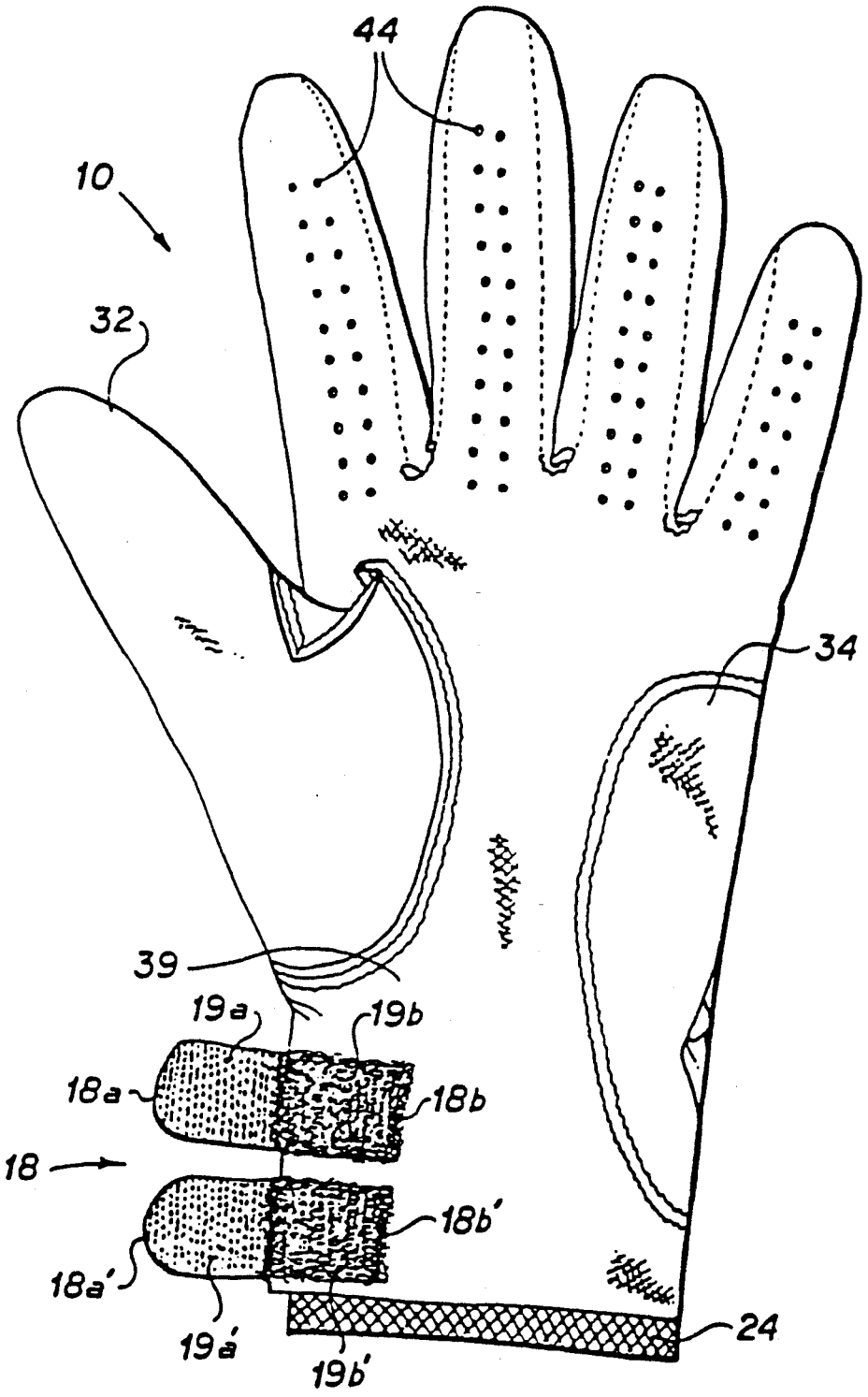
FIG. 2B is a palm-side plan view of the system of FIG. 2.

Glove 10 further includes closure mechanisms 18, for the purpose of aiding the user in donning (putting on) and doffing (removing) glove 10, elastic reinforced stitching 22 to help insure glove 10 retains a proper and uniform fit from use to use, and a soft moisture-absorbent forearm lining 24 for wicking or absorbing user perspiration. As shown in FIGS. 2A and 2B, glove 10 preferably has a thumb portion 32, a heel portion 34, a lateral or knuckle-side portion 38, and a palm side portion 39. The foregoing portions may have a plurality of material layers made of, for example, leather or another soft pliable resilient material. Lining 24 is manufactured from a soft moisture-absorbent material, such as cotton or terry cloth. A plurality of ventilation holes 44 are also provided throughout the glove to help minimize user perspiration. While a left-handed full-fingered glove is illustrated, the glove may be a right-handed glove with either being full-fingered, half-fingered or without fingers, although at least a thumb is preferred.

As illustrated in FIGS. 2, 2A, and 2B, glove 10 is provided with closure mechanisms 18, 20. Primary closure mechanism 18 is positioned below thumb portion 32 of the glove 10 and includes two pairs of engaging straps 18*a*, 18*b* and 18*a*', 18*b*'. The straps 18*a*, 18*a*' are partially connected to the lateral side portion 38 of glove 10 and have an exposed free end for engagement to respective straps 18*b*, 18*b*' connected to glove 10 directly below thumb portion 32, opposite the free end of respective straps 18*a*, 18*a*'. Preferably, the two pairs of engaging straps 18*a*, 18*b* and 18*a*', 18*b*' are engaged via a hook and loop fastening arrangement. Hook and loop fastening arrangements are manufactured and made commercially available by VELCRO TM Fastening Systems, Manchester, N.H., U.S.A. More specifically, straps 18*a*, 18*a*' include a plurality of plastic or nylon hooks 19*a*, 19*a*', respectively, protruding upwardly from the inner side of corresponding straps 18*a*, 18*a*'. Straps 18*b*, 18*b*' include a plurality of plastic or nylon loops 19*b*, 19*b*', respectively, protruding upwardly from the outer side of respective straps 18*b*, 18*b*'. When securing primary closure mechanism 18, the free portions of the engaging straps 18*a*, 18*a*' overlap with the respective engaging straps 18*b*, 18*b*' causing hooks 19*a*, 19*a*' to engage and lock with respective loops 19*b*, 19*b*'.

The present invention need only have a single engaging strap pair; however, two pairs are preferable because of the optimum securing functionality. Furthermore, many other types of closure mechanisms are known in the art and could be used to replace, in whole or in part, the preferred closure mechanism 18.

Glove 10 further includes a secondary closure mechanism 20, which is positioned on the lateral side of glove 10. Secondary closure mechanism 20 preferably includes an elastic loop 20*a* and button 20*b*. To engage the secondary closure mechanism 20, the elastic loop 20*a* is hooked around the button 20*b*, thus securing glove 10 about the user's hand 26 and the user's wrist 28. As with the primary closure mechanism 18, many other types of closure mechanisms are known in the art and could be used to replace, in whole or in part, the preferred closure mechanism 20. Furthermore, when closure mechanisms 18, 20 are not engaged, the user is able to releasably open lateral side portion 38 and lining 24. The lateral side portion 38 and wrist lining 24 are permitted to move away from the thumb-side of the glove 10, providing an enlarged access opening 30. As illustrated, access opening 30 is a linear slit running longitudinally near the thumb side of the glove 10. Glove 10 extends longitudinally at least sufficiently to overlie portions of the forearm and hand above and below the wrist joint 28, respectively, as illustrated in FIG. 2, 2A and 2B, for reasons discussed hereafter.

In this first embodiment, bladder 12 is principally positioned on the lateral side of glove 10 and is partially wrapped around the heel side (little finger side) of the user's hand 26. As a result, the air bladder 12 will inhibit wrist joint motion in flexion and extension, as well as adduction. Furthermore, bladder 12 can be configured to overlie the thumb side of the hand to inhibit wrist motion in abduction.

With reference to FIG. 2A, bladder 12 is mounted into the lateral side portion 38 by stitching border 48 along perimeter 50 of the air bladder 12. The lateral side portion 38 may be perforated to provide ventilation holes 44 to aid in minimizing user perspiration, similarly as the ventilation holes 44 are present along the fingers.

Figure 3:
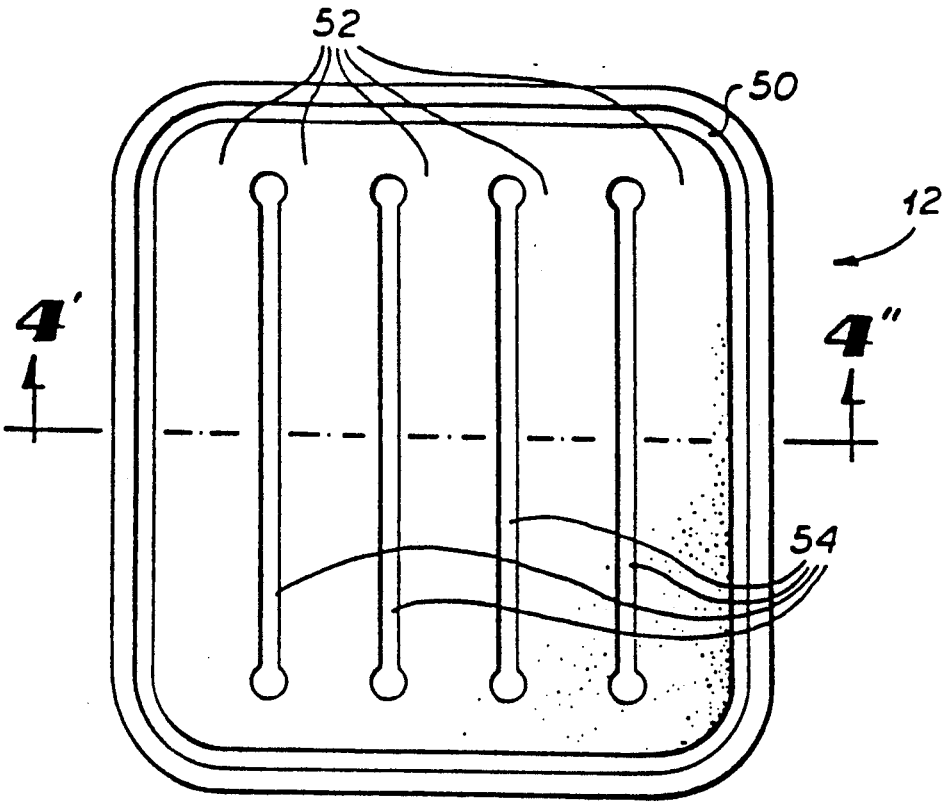
FIG. 3 is a plan view of an air bladder for the system of FIGS. 2 through 5.

FIG. 3 illustrates a preferred embodiment of bladder 12. Bladder 12 has a single, sealed air, fluid, e.g., chamber bound by a border 50 and subdivided into a series of smaller linear parallel compartments or chambers 52 by a plurality of laterally spaced seams 54. Pump 14 and release valve 16 may be interfaced at any location on the chambers defined by air bladder 12.

In the preferred embodiment, bladder 12 is manufactured from two layers of a resilient flexible urethane film manufactured and made commercially available by JPS Elastomerics Corporation ("Stevens Elastomerics"), Northampton, Mass., U.S.A. However, bladder 12 could be made of other materials having similar elastic properties, for example, plastic, vinyl, or the like. The border 50 and seams 54 are created by conventional sealing techniques, such as radio frequency (RF) heat sealing, which can be performed on demand by Dielectrics Industries, Chicopee, Mass., U.S.A. Furthermore, the top layer of the bladder material is preferably made slightly thicker or from a less elastic material as compared with the bottom layer or with a non-elastic material. This enables the increasing fluid pressure in the bladder channels to direct increasing force against the hand and forearm and to increase the rigidity of the channels. This also maintains an appealing outer profile without bulging into prominence.

Significantly, when bladder 12 is mounted within glove 10, chambers 52 extend longitudinally of the glove and users' arm and extend preferably substantially equal distances above and below the lateral centerline through the wrist joint principally along the lateral sides of the user's hand and forearm. The linear chambers 52 are spaced transversely one from the other with the interior seams terminating short at one or both ends thereof relative to the peripheral seam to provide open communication between the channels.

The forces exerted by bladder 12 are best illustrated in FIG. 4, which shows an enlarged cross sectional view of glove 10 taken along line 4'—4". As shown in FIG. 4, the fluid in channels 52 is disposed between an inner material layer 40 and an outer material layer 42. When inflated, the fluid in channels 52 exert forces F against the user wrist 28 to inhibit wrist joint motion in extension. While not shown in FIG. 4, it is essential that glove 10 lie taut about the user's hand and forearm and, importantly, bladder 12, such that the bladder may also inhibit wrist joint motion in flexion. Additionally, with bladder 12, vibrational shock to the user's body is minimized when the user glove 10 strikes a ball. For example, glove 10 and bladder 12 reduce the vibrational shock to the arms, elbows, and shoulders of a golfer when the golfer strikes a golf ball with a golf club. Also, the air cushioning puts the golfer in the best position for absorbing a mis-hit on the golf ball. The channels also enhance the profile and aesthetic appearance of the glove 10 while avoiding prominence. It will also be appreciated that seams 54 may be widened slightly so that ventilation holes, for example, illustrated at H in FIGS. 14 and 15, can pass through the seams 54. Such ventilation holes help reduce the perspiration of the user's hand 26. The holes through either or both of the interior and peripheral seams may be used as sewing guides when the bladder is secured to the glove by stitching through the seams.

The pump 14 and release valve 16 are preferably positioned anywhere on the lateral side of glove 10, as shown in FIGS. 2 and 2A, and interfaced to one of the bladder channels 52. Moreover, pump 14 and release valve 16 can be manufactured as separate components, as illustrated in FIGS. 5A and 5B respectively, or alternatively, the pump 14 and the release valve 16 may be combined in a single regulating unit 62, as shown in FIG. 5C.

Figure 5A:
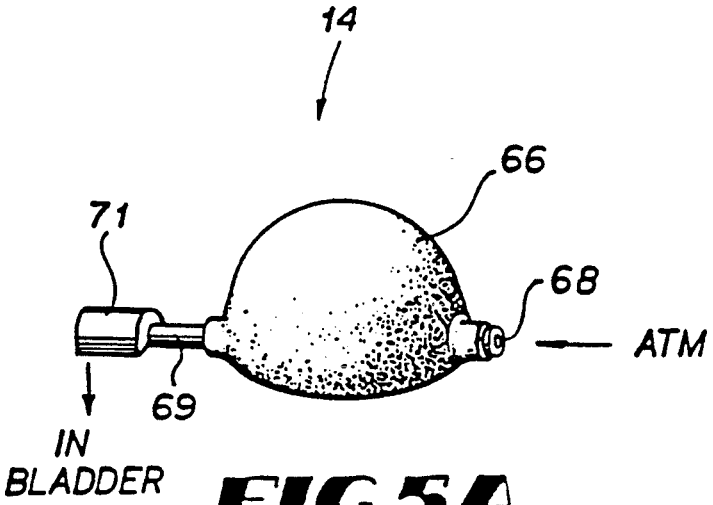
FIG. 5A is a perspective view of an air pump for the apparatus of FIG. 2.

With reference to FIG. 5A, pump 14 has a flexible, hemispherical housing 66 which enables the user to manually pump ambient air from an inlet orifice 68 into air bladder 12. A one-way valve, or a check valve 71, is situated to receive ambient air from housing 66 through a tube 69. Preferably, the check valve 71 is a "duck bill" valve, which is known in the art. Check valve 71 permits air flow in only one direction into the air bladder 12 and prevents reverse flow to housing 66. Check valve 71 thus has an internal diaphragm or plunger which closes the air passageway in response to back pressure or opens the air passageway in response to a flow of pressurized air from housing 66. In addition, a one-way ball valve or diaphragm (not shown) may be positioned near the inlet orifice 68 to enable flow of air into housing 66 and prevent outflow of air therefrom.

In a preferred embodiment of air pump 14, check valve 71 and tube 69 are formed of thermoplastic, urethane, or other similar materials. These structural components are injection molded in totality or in piece-wise fashion. If the components are manufactured separately, the components can be bonded together using any conventional technique, such as gluing or radio frequency (RF) heating, which techniques are well known in the art. A "duck bill" check valve which can be implemented in the present invention is commercially available from Vernay Laboratories, Inc., Yellow Springs, Ohio, U.S.A. Furthermore, pump housing 66 is preferably formed of a rubber, vinyl, flexible elastic material, or other flexible substance having the functionality as described previously. Such housing 66 is commercially available from The Rehn Co., Toledo, Ohio, U.S.A., under the trade name of "double port turtle back inflator bulb." Note that the housing 66 can be formed to resemble a portion of a golf ball, tennis ball, baseball, or other sport symbol so as to enhance the aesthetic appeal of the glove 10.

Figure 5B:
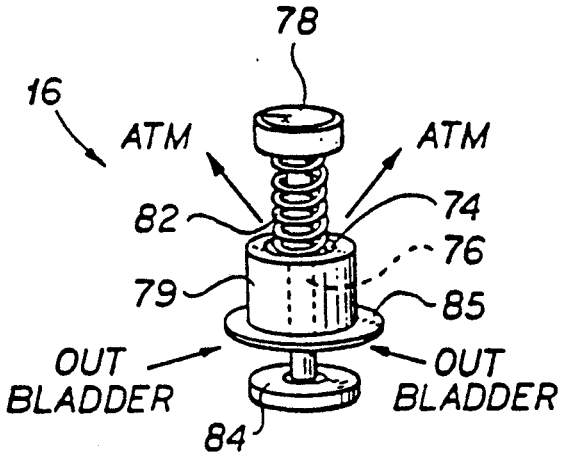
FIG. 5B is a perspective view of a air release valve for the system of FIG. 2.
Figure 5C:
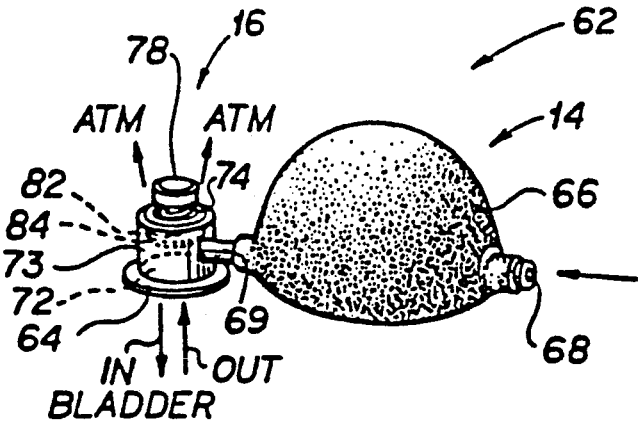
FIG. 5C is a perspective view of a regulating unit for the system having both the air pump of FIG. 5A and the air release valve of FIG. 5B.

Release valve 16 is illustrated in FIG. 5B. The release valve has an outlet orifice 74 for venting air from the bladder to atmosphere. Outlet orifice 74 is blocked by a spring-loaded plunger mechanism having a rod 76. A manually depressible air release button 78 is connected to rod 76, a support housing 79 being connected to the air bladder 12. A spring 82 exerts a force between button 78 and support housing 79, to maintain a valve member 84 sealed against an interior wall surface of the bladder. When the bladder is to be deflated, the user presses button 78 against the bias of spring 82, causing plunger 84 to be displaced from the bladder interior wall surface thereby to release air through outlet orifice 74.

In the preferred embodiment of the release valve 16, the rod 76, button 78, spring 82, and the plunger 84 are metal. Moreover, the support housing 79 is a thermoplastic, urethane, or other similar material, and is affixed in a conventional manner, such as through RF heating, to the air bladder 12 by flange 85.

FIG. 5C illustrates the pump 14 and the release valve 16 combined in a self-contained, single-piece regulating unit 62 for glove 10. Referring to FIG. 5C, the regulating unit 62 has a flange 64 bonded to bladder 12, e.g., by RF sealing or an adhesive compound. The flexible, hemispherical housing 66 enables the user to pump air from the inlet orifice 68 into air bladder 12 via outlet orifice 72 surrounded by flange 64. To deflate bladder 12, the regulating unit 62 has an outlet orifice 74 blocked by a spring-loaded plunger mechanism having a manually-actuated air release button 78, plunger 84, under the bias of spring 82, occluding outlet orifice 74. To deflate the bladder, the user depresses button 78 to depress spring 82 and plunger 84 and thereby releasing air from bladder 12 through the outlet orifice 74.

In operation, and assuming the bladder is substantially deflated, primary closure mechanism 18 is disengaged by pulling, or "peeling," engaging straps 18*a*, 18*a'* away from respective engaging straps 18*b*, 18*b'*, and the secondary closure mechanism 20 i s disengaged by unhooking the loop 20*a* from button 20*b*. Next, knuckle-side portion 38 and wrist lining 24 of the glove 10 are then hingedly opened away from the remainder of the glove 10 to provide an enlarged access opening 30 for the user's hand 26. Upon full insertion of the user's hand into glove 10, the glove 10 covers both the user's hand and portion of his forearm. Once the glove is donned, it will be appreciated that the air bladder is centrally located over the wrist joint on the lateral sides of the hand and forearm below and above the wrist joint, respectively. In this embodiment, the air bladder 12 also wraps around the heel side of the user's wrist 28. Once the glove 10 is donned, the user secures the knuckle-side portion 38 and wrist portion 24 by engaging closure mechanisms 18, 20. This causes the bladder to tightly engage the hand and forearm portions.

With the glove 10 securely fastened, bladder 12 is inflated by manually depressing the hemispherical flexible housing 66 of pump 14 to pump ambient air into bladder 12, causing channels 52 to inflate. With the bladder taut against the hand and forearm, the inflation pressure rigidifies the channels substantially rigid. The channels held tightly against the user's hand and forearm along lateral sides thereof by glove 10 thus inhibit user wrist joint motion in flexion and extension from a sports-neutral position wherein the lateral sides of the user's forearm and hand above and below the wrist joint, respectively, lie substantially in a common lateral plane, i.e., 0° flexion and extension. Additionally, with at least one of the channels wrapped about the heel side of the hand and corresponding side of the forearm, wrist joint motion in adduction is likewise substantially inhibited from the sports-neutral position of 0° adduction.

Once the air bladder 12 is inflated, the air volume within the air bladder 12 may be regulated by air pump 14 and release valve 16.

Figure 6:
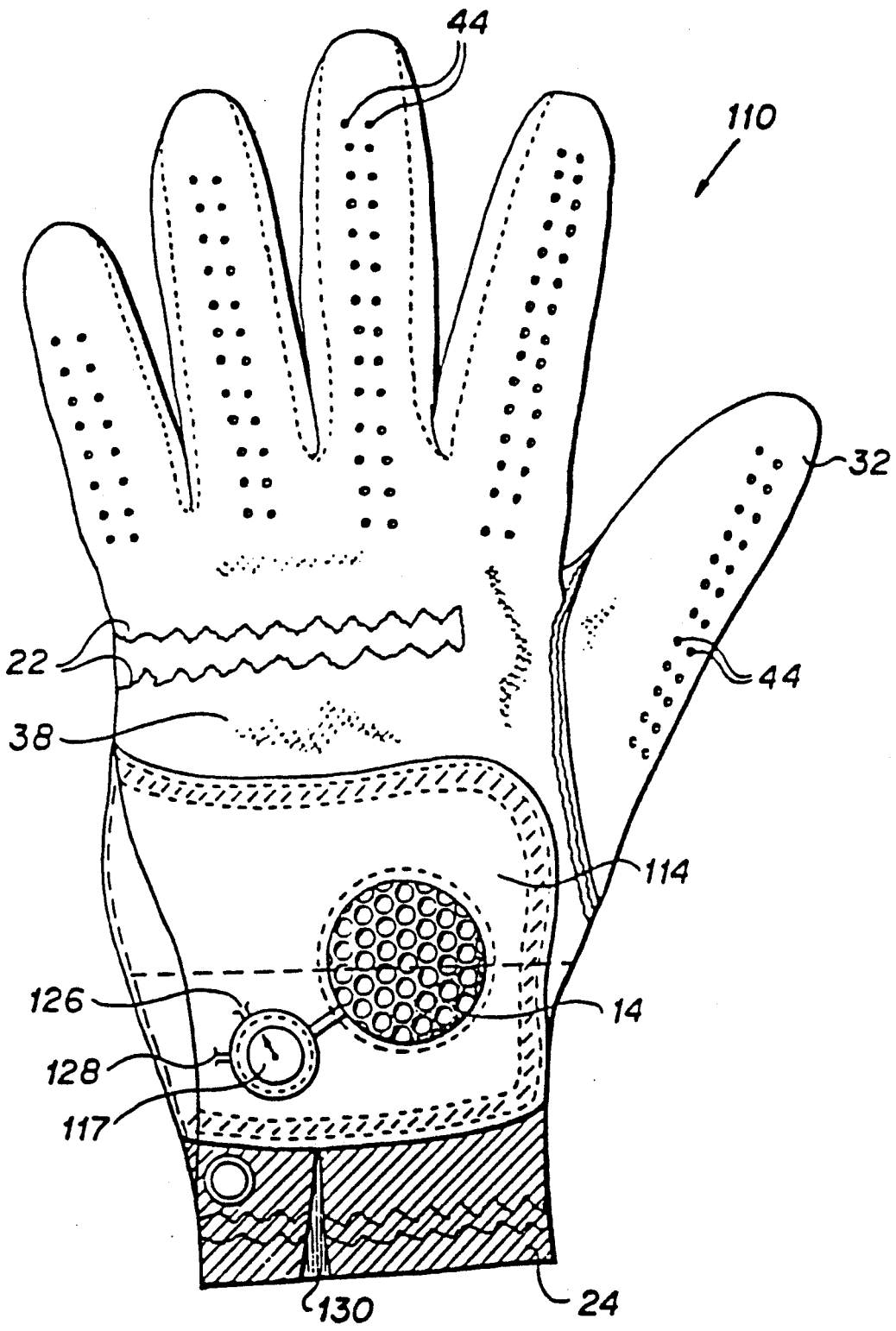
FIG. 6 is a lateral or knuckle-side plan view of a system in accordance with a second embodiment of the present invention.

In a second embodiment of the present invention as shown in FIG. 6, glove 110 has the air pump 14 positioned on the lateral side of the user's hand. In glove 110, bladder 12 is positioned within the material layers of a foldover portion 114, which wraps around the lateral side of the glove 110 and can be secured tightly on its underside by a hook-and-loop fastening arrangement. Hence, the foldover portion 114 serves as both a closure mechanism and a support for bladder 12.

Figure 7:
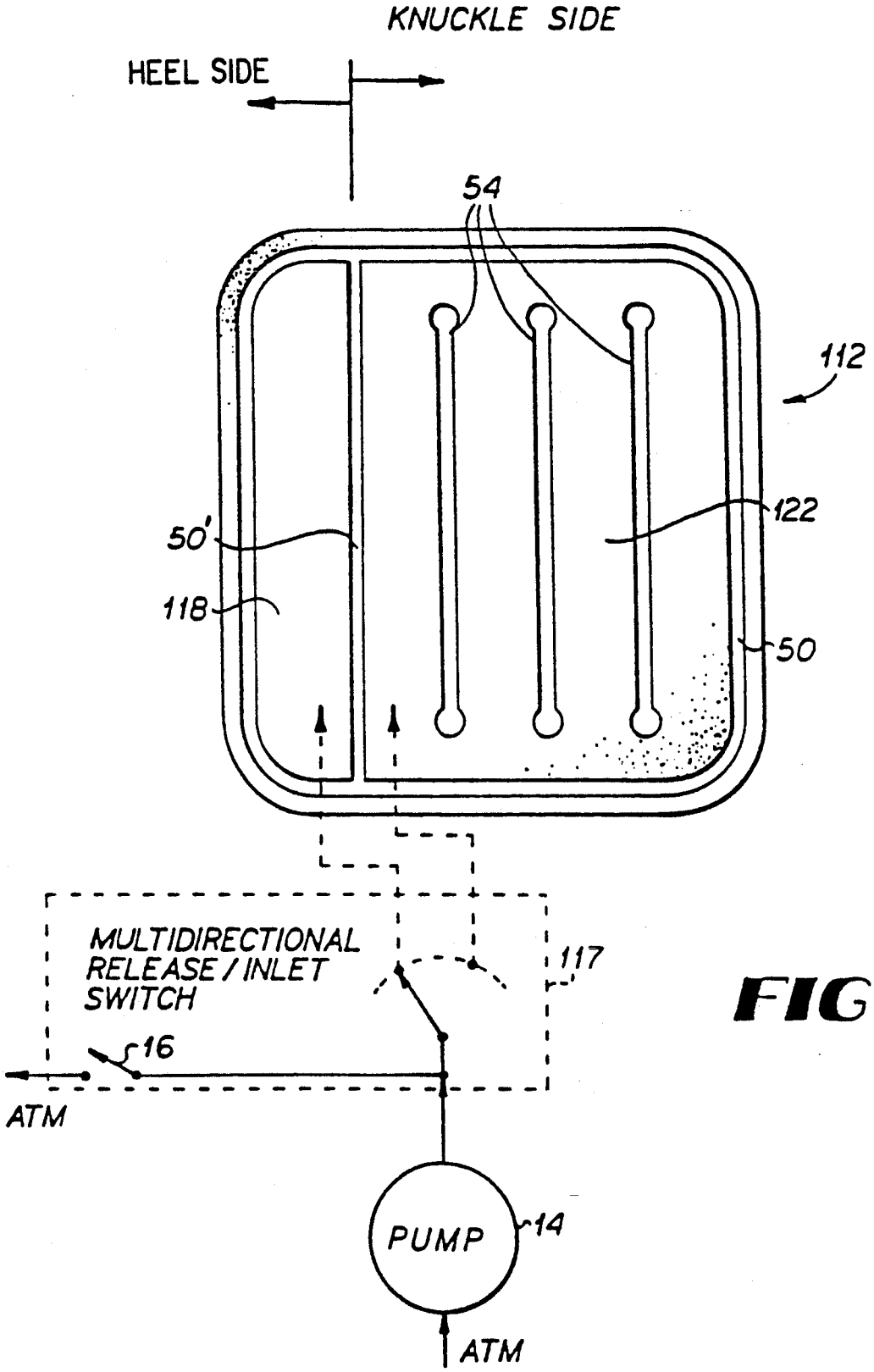
FIG. 7 is a plane view of a multichamber bladder with a schematic view of a multidirectional release/inlet switch for the glove of FIG. 6.

A significant feature of the glove 110 is that the user has the ability to independently regulate the pressure exerted by bladder 112 against the lateral and heel sides of the user's hand and corresponding sides of the forearm. In order to permit independent control, the air bladder 112 is divided into two separate chambers, as illustrated in FIG. 7. During manufacture of air bladder 112, a seam 50' is formed completely across the air bladder 112 so as to create a heel-side channel 118 and lateral side channels 122. To permit independent control, a multidirectional release/inlet valve 117 is disposed on the foldover portion 112, as shown in FIG. 6. The functionality of the multidirectional release/inlet valve 116 is schematically shown in FIG. 7. The multidirectional release/inlet valve 117 can be switched so that both release valve 16 and pump 14 communicate to either the heel-side channel 118 or the lateral side channels 122.

Figure 8:
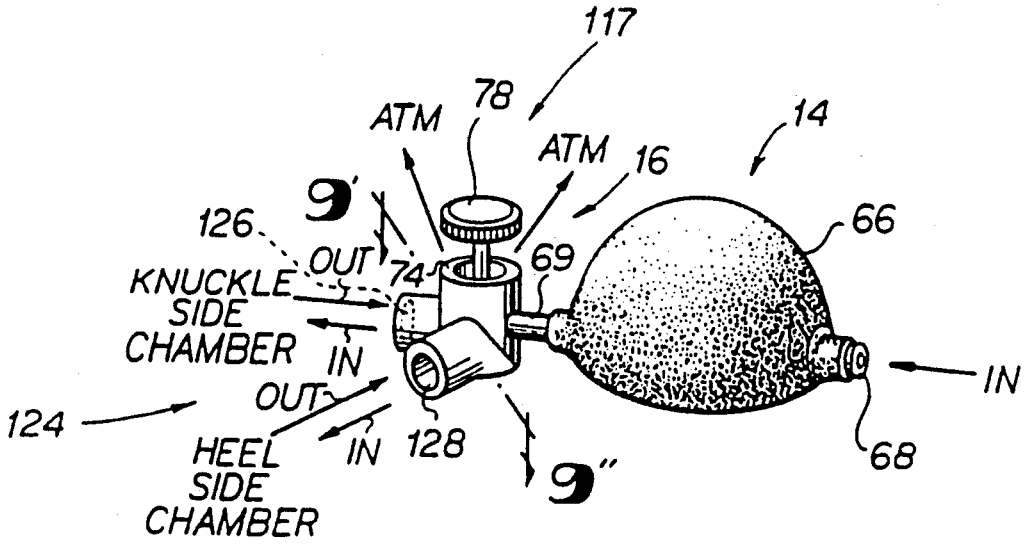
FIG. 8 is a perspective view of a regulating unit for the glove of FIG. 6.
Figure 9:
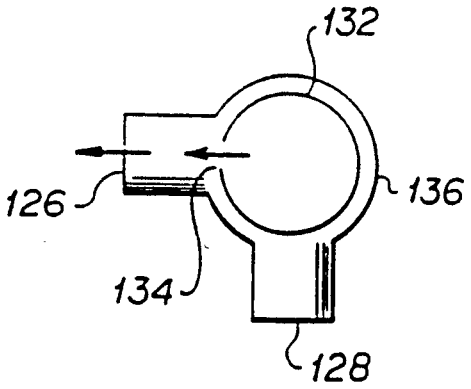
FIG. 9 is an enlarged, partial, cross sectional view of the regulating unit of FIG. 8 taken along line 9'–9''.

The multidirectional release/inlet valve 117 can be constructed in similar form to the regulating unit 62 of FIG. 5. However, the bladder inlet 72 is provided with directional capabilities so that bladder inlet 72 can be selectively connected to either the heel-side channel 118 or the lateral side channels 122. The preferred embodiment of the multidirectional release/inlet valve 117 combines the valve 117 with the pump 14, as shown in FIG. 8. In FIG. 8, bladder inlet 72 is provided with a "Y" interface 124, having a lateral or knuckle side channel inlet 126 and a heel-side channel inlet 128. A cross sectional view of the Y interface 124 taken along line 9'—9" is illustrated in FIG. 9. In FIG. 9, a rotatable, cylinder-like or ball-like directing member 132 is disposed to communicate air flow with either the knuckle-side channel inlet 126 or a heel-side chamber inlet 128. During inflation, air is directed downwardly to the view as shown in FIG. 8. The air is received centrally to the directing member 132 and is channeled outwardly through an aperture 134, e.g., to the knuckle-side channel inlet 126. Member 132 is rotatable within a housing 136 preferably by rotation of a button 78. While rotatable, member 132 is in close sealing relation with housing 136 so that when one of the inlets 126, 128 is opened, the other inlet 128, 126 is closed.

Figure 10:
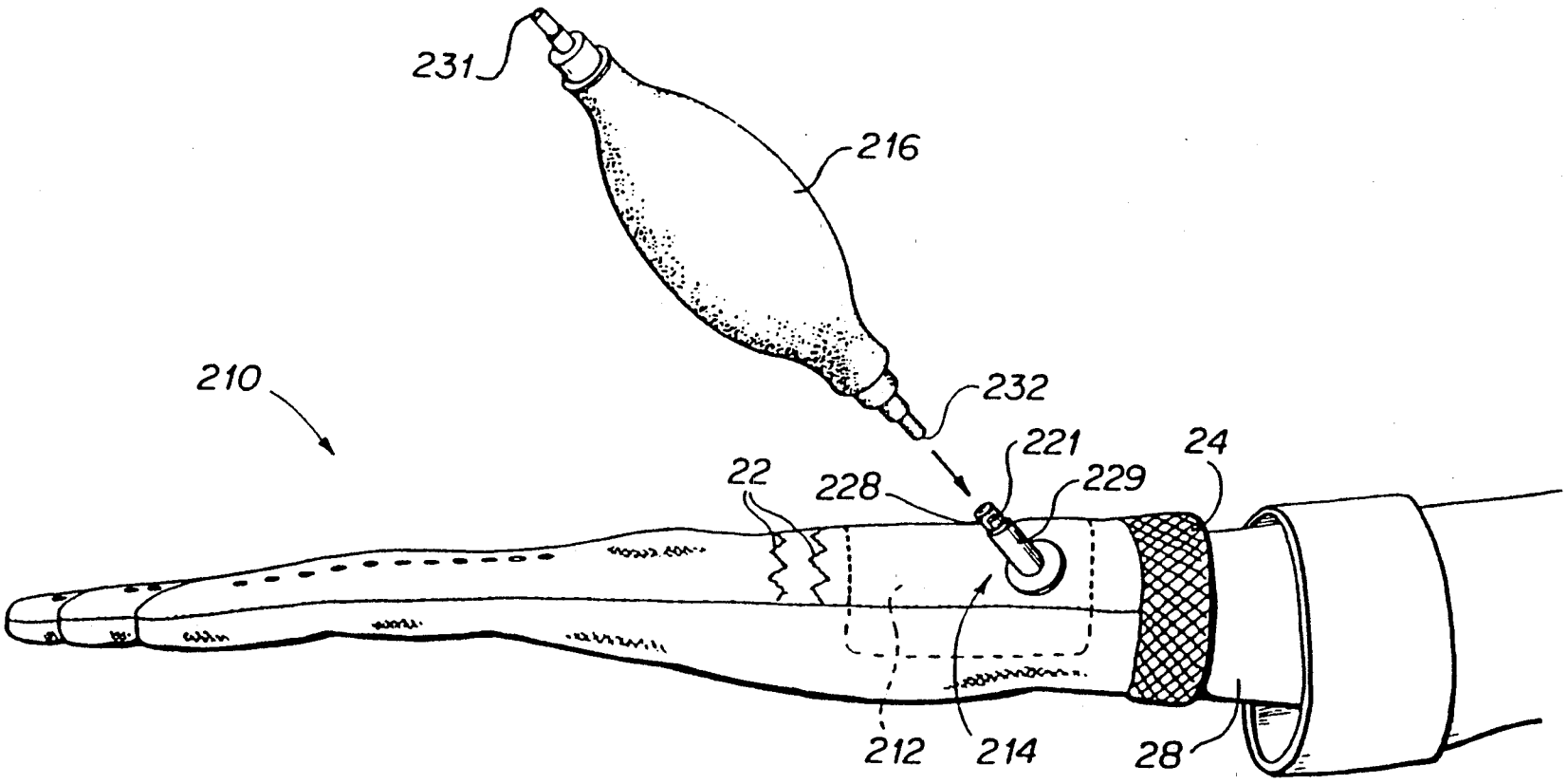
FIG. 10 is a side view of a system in accordance with a third embodiment of the present invention.

FIG. 10 illustrates a side view of a third embodiment of the present invention. In FIG. 10, a glove 210 is equipped with a conventional check/release valve 214 for inflating and deflating an internal air bladder 212. As a result, the glove 210 does not require a pump fixed to the glove and/or bladder as in the first and second embodiments. More specifically, as shown in FIG. 10, glove 210 has a check/release valve 212 preferably exposed externally at the heel side of the glove and angled slightly upwardly for easy engagement of a remote air pump, for example, a conventional inflator bulb 216, sometimes referred to as a "double valve bulb."

Figure 11A:
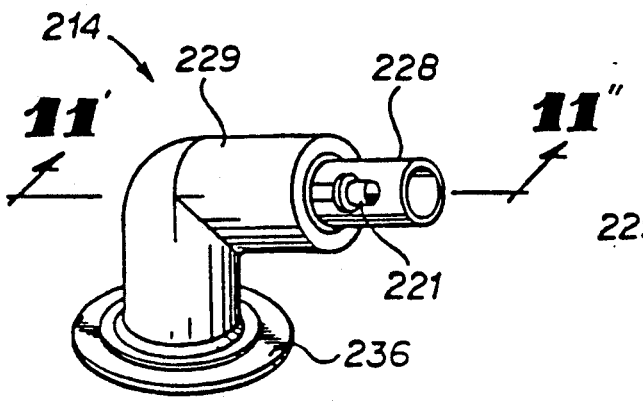
FIG. 11A is a perspective view of a check/release valve for the system of FIG. 10.
Figure 11B:
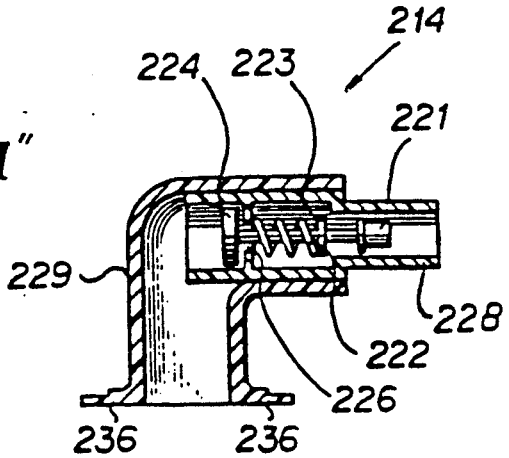
FIG. 11B is a cross sectional view of the check-/release valve of FIG. 11A taken along line 11'–11''.
Figure 12:
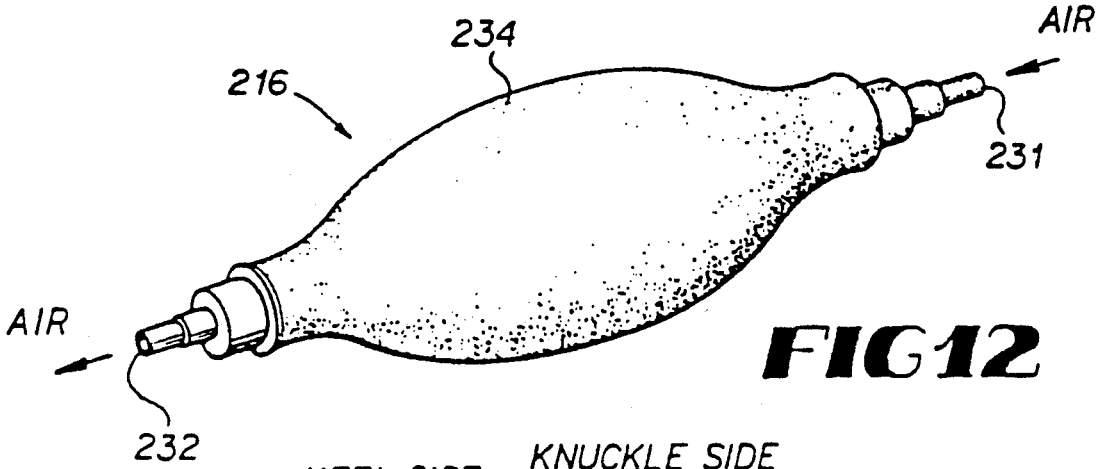
FIG. 12 is a perspective view of an inflater bulb for the system of FIG. 10.

A preferred embodiment of the check/release valve 212 is shown in FIGS. 11A and 11B. In these Figures, valve 212 has a spring-loaded internal plunger mechanism 218 having a depression rod 221, a spring 222 bonded to depression rod 221 at end 223 thereof and which exerts valve-closing pressure on rod 221, valve head 224 connected to rod 221, an internal air orifice 226 which is either closed or opened by plunger 224, a cylinder-like housing 228 for containing the exposed tip of rod 221, and a bladder interface housing 229 containing plunger 224 and air orifice 226 and which is connected directly to bladder 212. Plunger 224 permits air to be pumped into the bladder 212 when rod 221 is depressed and prevents air from escaping bladder 212 when rod 221 closes orifice 226 under the bias of spring 222. Inflator bulb 216, illustrated in FIG. 12, for use with valve 214, is commercially available from Walter Stern, Inc., Port Washington, N.Y., U.S.A. Inflator bulb 216 sucks in air at an inlet orifice 231 and blows air out of an outlet orifice 232 when a center region 234 is squeezed by the user. Thus, the inflator bulb 216 exhibits one way air flow operation.

To inflate glove 210, inflator bulb 216 is inserted into the check/release valve 212 to depress rod 221, which, in turn, opens air orifice 226. The inflator bulb 216 is then repetitiously squeezed by the user to inflate the bladder 212 to a desired pressure level. In order to deflate the bladder 212, rod 221 is depressed by inserting an instrument into the cylinder-like housing 228 and displacing rod 221 against the bias of spring 222.

Figure 13:
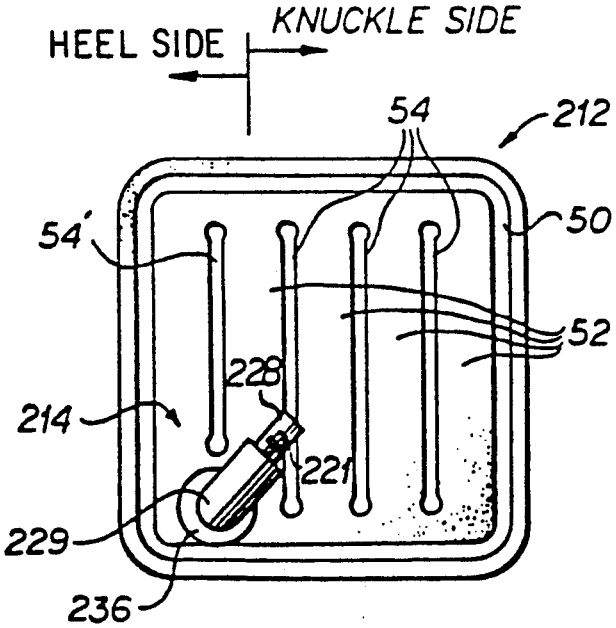
FIG. 13 is a plan view of an air bladder for the system of FIG. 10.

The preferred embodiment of bladder 212 illustrated in FIG. 13 is substantially similar to the bladder 12 of the first embodiment. However, as shown in FIG. 13, a short seam 54' is disposed at the far left of the bladder 212. When the bladder 212 is incorporated into glove 210, the short seam 54' resides at the heel side of the glove 210. The incorporation of the short seam permits the check/release valve 214 to be positioned on the bladder 212 just below the short seam 54'. The check/release valve 214 can be interfaced to the bladder 212 via RF sealing a flange 236 to the bladder 212.

Figure 14:
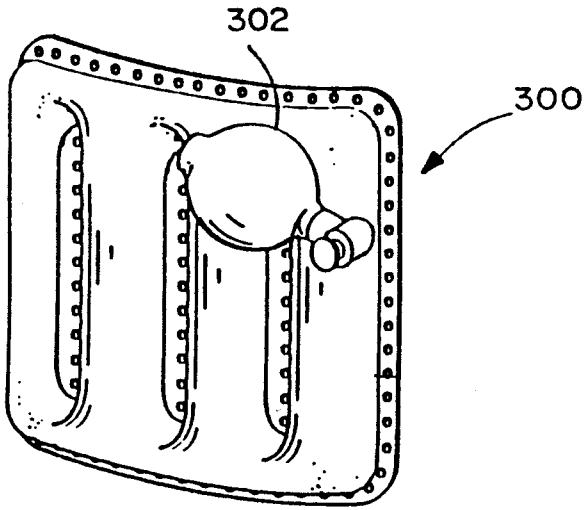
FIG. 14 is a perspective view of a multi-chamber bladder in accordance with a further embodiment of the present invention.
Figure 15:
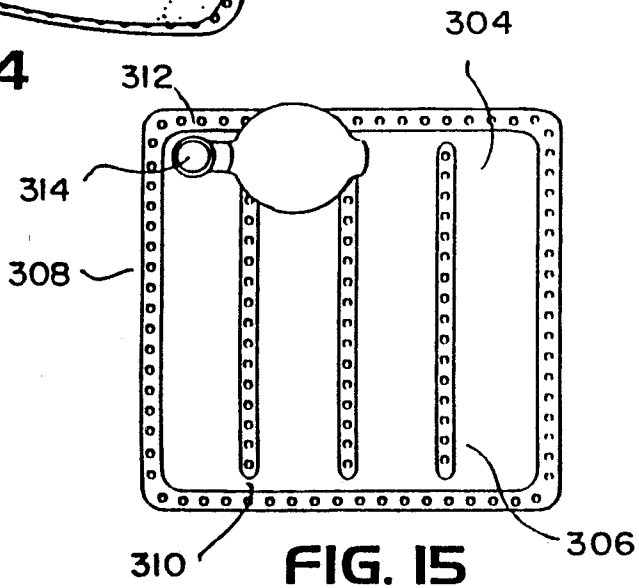
FIG. 15 is a front elevation view of the bladder of FIG. 14.

Referring now to drawing FIGS. 14 and 15, there is illustrated a further form of bladder, generally designated 300, with different locations of a pump 302, which pump may, for example, be of the type illustrated in FIGS. 5A and 5C. In this form, bladder 300 has provided four generally parallel linearly extending inflatable channels or chambers 304, separated laterally by seams 306, the entire bladder having a peripheral seam 308. As in the prior embodiments, the walls of the bladder are formed of heat-sealable materials and the seams are thus formed by heat-sealing predetermined areas of the walls to one another, as illustrated. FIG. 14 illustrates the bladder in an inflated condition, while FIG. 15 illustrates the bladder in a deflated condition. Note the passages 310 between the ends of the seams 306 and the peripheral seam 308 which afford open communication between the chambers 304.

The pump 302 may be positioned at any suitable location relative to the bladder. For example, in FIG. 14, the flange of the regulating unit 312, which includes the deflation valve 314, may be secured by bonding to the air bladder 300. Another position of the bladder is illustrated in FIG. 15. The position of the air pump is determined in large part by the position of the closure for the glove.

In this form of bladder, the four channels overlie only the lateral sides of the user's hand and forearm below and above the wrist, respectively. Thus, wrist joint motion is inhibited using bladder 300 in conjunction with a glove holding the bladder taut against the lateral sides of the hand and forearm in only flexion and extension.

In FIG. 16, there is illustrated a further form of wrist-stabilization system according to the present invention. In this form, the system includes a glove 400 having a pair of tab closures 402 and 404 below and above, respectively, the lateral centerline A of the wrist joint. The tabs 402 and 404 are releasably secured to corresponding mating pad portions 406 and 408, respectively, secured on the glove 400. Suitable securing means is provided to releasably secure the tabs 402 and 404 to the respective mating portions 406 and 408, such as hook-and-loop type fasteners previously described.

In this form of the present system, the bladder, for example, the bladder illustrated in FIG. 14, is disposed below pad portions 406 and 408 and secured to the overlying glove portions, for example, by stitching along the peripheral seam 308 and/or one or more of the internal seams 306 of the bladder to properly locate the bladder relative to the glove. As indicated previously, holes H along the seams may be used as a sewing guide. The portion of the bladder not secured to the glove extends laterally to underlie the tabs 402 and 404 as illustrated. Accordingly, the unsecured margin of the bladder underlying tabs 402 and 404 facilitates the formation of an enlarged access opening for receiving the user's hand within the glove. Once the user's hand is within the glove and the tabs 402 and 404 are secured to the pads 406 and 408, bladder 300 is secured in proper location with its chambers 304 extending generally linearly and parallel to the forearm with substantially equal portions of the chambers lying above and below the wrist joint along the lateral sides of the hand and forearm. In the glove illustrated in FIG. 16, mating pad 406 and strap 402 may have registering openings sized to receive the hemispherically-shaped pump housing 302. That is, when the tab 402 is secured to pad 406, the registering openings surround the flexible pump housing and provides external access to the pump such that the bladder may be manually inflated after the user has donned the glove. Additionally, the glove may have an opening along its back side to receive the head 410 of the deflation valve 314. Consequently, the user may deflate the bladder by pressing the deflation valve prior to removing the glove from his hand.

Referring now to FIG. 17, there is illustrated a further form of a stabilization system according to the present invention as used with a sports glove 500. In this form, the bladder may be of the four-channel type, as illustrated in FIGS. 14 and 15, and sewn into the inside of the glove, as previously described. One side of the bladder is thus free when the closure tabs 502 and 504 are moved from securement with the underlying pads 506 and 508, respectively, enabling the individual to don the glove.

In this form, however, the pump 510 is releasably secured to the glove, for example, by hook-and-loop connections. To accomplish this, the lower securing tab 504 carries hook connections along an outside surface thereof for releasable securement with loops formed on the undersurface of the hemispherically-shaped pump. In this form, the pump has an air inlet opening/check valve 512, and an outlet 514 in communication with a female connecting tube 516. The outlet 514 and connecting tube 516 are, in turn, coupled to the deflator valve 518. The foregoing elements therefore constitute a pump assembly separable from the stabilization system and having a deflator valve and a connection for connecting to the inlet of the bladder. The bladder has a tube 517 passing through and sealed to its surface and which tube forms male fitting for releasable connection with the female connection tube 516 of the pump.

When the user inserts his hand into the glove and the tabs 502 and 504 are closed tightening the bladder about the lateral sides of the hand and forearm, the pump 510 is coupled to the bladder. Particularly, the male fitting 517 projecting from the bladder is inserted into the female connecting tube 516. With those tubes connected, pump 510 can be manually depressed to pump air into the bladder and inflate the channels 304. As in the prior embodiments, it will be appreciated that the channels extend substantially and generally parallel to the forearm equally above and below the wrist joint A. With the glove wrapped tightly about the individual's hand and forearm, the inflated bladder thus inhibits movement of the wrist joint in flexion and extension to maintain the lateral sides of the hand and forearm in a generally common lateral plane. If desired, a check valve may be placed in the male fitting whereby the pump, once the bladder has been inflated, can be removed from the glove.

Referring now to FIG. 18, there is provided a wrist-stabilization system comprised of a wristband and bladder which form an integral part separated from an overlying glove, not shown. In this form, there is provided a wristband 600, preferably formed of elastic material. Band 600 has releasable fasteners, not shown, at its opposite ends whereby the band can be disposed about the individual's forearm substantially above the wrist joint and secured thereto. A bladder 602, for example, of the type illustrated in FIGS. 14 and 15, is secured to the wristband 600, preferably along the inside of the wristband. Thus, a lower portion of the bladder 602 may be sewn into the wristband with an overlying strip of material, not shown, secured along the inside surface of the wristband, forming a pocket for receiving the lower end portion of the bladder. As illustrated, a substantial portion of the bladder projects freely below the wristband 600. The bladder carries a male inflating tube which may be connected to the female inflating tube of a pump 604, similarly as previously described. The pump 604 and associated deflation valve may be of the type described with respect to FIG. 17 and may be releasably secured to the wristband, for example, by hook-and-loop type fasteners or permanently secured thereto. As in shown in FIG. 18, the bladder is positioned along the lateral "L" side of the hand spaced from the base of the thumb and includes a leading edge 602' and a rear edge 602'. The trailing edge terminates in spaced relationship to the knuckles along the lateral "L" side of the hand and the rear edge extends along the forearm above the wrist.

When using the wristband, the user wraps the wristband about his forearm above the wrist joint such that the bladder channels will extend substantially equally above and below the wrist joint and generally parallel to the forearm. A glove, not shown, may then be donned by the user with the bladder being located between the glove and the user's hand. It is necessary to close the glove tightly about the user's hand and about the wristband and bladder to ensure that the bladder is held taut against the back of the hand and forearm above and below the wrist joint. Once the glove has been donned, the pump is manually actuated to inflate the channels of the bladder. When inflated, the inflated channels inhibit movement of the wrist joint in flexion and extension from a position wherein the lateral sides of the hand and forearm below and above the wrist joint lie in a common lateral plane.

In a particular preferred embodiment of the bladder hereof, the bladder preferably has opposite lateral sides of equal length in a generally rectangular configuration having a length of $3\frac{1}{8}$ inches and a width of 3 1/16 inches. The perimeter seal has a width preferably of $\frac{1}{4}$ inch with the corners on $\frac{1}{2}$ inch radii. The internal seams have a minimum width of 3/16 inch and lie on centers spaced 11/16 inch from one another. This is a function of RF sealing equipment, the bladder materials and the inflation pressures. The seams laterally adjacent the side perimeter seals have a distance from their centerlines to the internal side edges of the side perimeter seals of 19/32 inch. Where the ends of the interior seams are both spaced from the upper and lower perimeter seals, that spacing is preferably $\frac{1}{8}$ inch. This is necessary to afford sufficient air communication between the inflatable channels. The channels therefore have a length preferably of $2\frac{5}{8}$ inches. The bladder may have a different overall shape, e.g., disk-like, octagonal, cruciform or the like which might necessitate channels of different lengths and/or widths. Preferably, however, the bladder is rectangular with four channels of equal length and width to maximize utility.

It will be obvious to those skilled in the art that many variations may be made to the embodiments hereof without departing from the novel teachings of the present invention. For example, instead of using ambient air in the preferred embodiments, other fluids, such as other gases or even liquids, could be utilized to obtain wrist stabilization. As another example, the bladder could be presealed with a certain fluid pressure during manufacture so as to provide a usable wrist-restrictive glove.

In any event, it will be appreciated that by the foregoing described invention, there has been provided a wrist-stabilization system for inhibiting movement of the wrist joint in flexion and extension to assist in maintaining the lateral sides of the hand and forearm in a common lateral plane. Thus, the wrist-stabilization system inhibits wrist motion in flexion and extension from a sports-neutral position of 0° flexion and extension.

While the invention has been described with respect to what is presently regarded as the most practical embodiments thereof, it will be understood by those of ordinary skill in the art that various alterations and modifications may be made which nevertheless remain within the scope of the invention as defined by the claims which follow.

What is claimed is:

1. An apparatus for use with a glove for inhibiting movement of an individual's wrist joint in flexion and extension from a position wherein the lateral side of the individuals forearm and hand above and below the wrist joint, respectively, lie substantially in a common lateral plane without interfering with the normal movement and gripping use of the fingers, knuckle joints, thumb and palm of the individual's hand, the apparatus comprising;

a wrist-stabilizing means including a fluid-inflatable bladder means, said bladder means being spaced from the medial side of the hand and wrist and being of a size to extend along the lateral side of the hand and forearm from a leading edge which extends below the wrist joint but spaced from the knuckles and thumb to a rear edge above the wrist joint along the forearm when the apparatus is worn;

adjusting means mounted to said bladder means for securing said bladder means substantially taut against the lateral side of the individual's forearm in the area of the individual's wrist joint, said adjusting means being mounted so as to be in spaced non-interfering relationship with the fingers, knuckle joints, thumb and palm when the apparatus is worn;

means for regulating the fluid volume within said bladder means, whereby when the apparatus is worn and a glove worn in overlaying relationship thereto the apparatus will substantially inhibit movement of the wrist joint in flexion and extension from a position wherein the lateral side of the individual's forearm and hand above and below the wrist joint, respectively, lie substantially in a common lateral plane.

2. Apparatus according to claim 1 wherein said bladder means includes a plurality of inflatable chambers which extend generally parallel to the forearm so as to extend above and below the wrist joint when the apparatus is worn, said chambers having upper and lower walls.

3. Apparatus according to claim 2 wherein one of said upper and lower walls has a greater elasticity than the other of said upper and lower walls.

4. Apparatus according to claim 2 wherein said upper and lower walls are formed of heat-sealable material, said chambers being formed by seams extending parallel to said chambers and laterally spaced from one another, said seams including heat-sealed portions of said upper and lower walls.

5. Apparatus according to claim 4 wherein said bladder means includes a peripheral seam, said peripheral seam including heat-sealed portions of said upper and lower walls.

6. Apparatus according to claim 2 in which one of said upper and lower walls includes a material for restricting the volume of said chambers upon inflation thereof to increase the internal pressure within said chambers and their rigidity.

7. Apparatus according to claim 6 wherein said upper and lower walls are formed of a heat-sealable material, said chambers being formed by seams extending parallel to said chambers and laterally spaced from one another, said seams including heat-sealed portions of said upper and lower walls, said bladder means including a peripheral seam, said peripheral seam including heat-sealed portions of said upper and lower walls.

8. Apparatus according to claim 2 wherein said bladder means has a width sufficient to extend to the heel side of an individual's hand when the apparatus is worn, at least one of said inflatable chambers extending generally parallel to the forearm above and below the wrist joint to overlie the heel side of the hand and corresponding side of the individual's forearm such that said bladder means stabilizes the wrist joint in adduction when the apparatus is worn.

9. Apparatus according to claim 2 wherein said chambers are in fluid communication with one another so that upon inflation, the internal pressure within said chambers and their rigidity is increased.

10. Apparatus according to claim 9 wherein said chambers are separated by seams, and a plurality of spaced openings in said seams, and a plurality of spaced openings in said seams.

11. Apparatus of claim 1 wherein said means for regulating fluid pressure includes a manually operable flexible inflator bulb, said inflator bulb being connected to said bladder means whereby pressure within said bladder means is adjusted by manually flexing said inflator bulb to inflate said bladder means.

12. Apparatus of claim 11 including a manually actuated deflation valve connected to said bladder means.

13. Apparatus of claim 1 in which said bladder means includes a plurality of inflatable chambers extending generally parallel to one another with substantially equal portions of said chamber lying above and below a lateral centerline through the individual's wrist joint when the apparatus is worn.

14. The apparatus of claim 1 in which said bladder means includes a plurality of inflatable chambers extending generally parallel to one another with substantially equal portions of said chamber lying above and below a lateral centerline through the individual's wrist joint when the apparatus is worn.

15. An apparatus for inhibiting movement of an individual's wrist joint in flexion and extension from a position wherein the lateral side of the individuals forearm and hand above and below the wrist joint, respectively, lie substantially in a common lateral plane without interfering with the normal movement and gripping use of the fingers, knuckle joints, thumb and palm of the individual's hand, the apparatus comprising in combination;

a glove;

a wrist-stabilizing means including a fluid-inflatable bladder means, said bladder means being spaced from the medial side of the hand and wrist and being of a size to extend along the lateral side of the hand and forearm from a leading edge which extends below the wrist joint but spaced from the knuckles and thumb to a rear edge above the wrist joint along the forearm when the apparatus is worn;

said glove having portions overlaying said bladder means, adjusting means mounted to said glove means for securing said bladder means substantially taut against the lateral side of the individual's forearm in the area of the individual's wrist joint, said adjusting means being mounted to said glove means so as to be in spaced non-interfering relationship with the fingers, knuckle joints, thumb and palm when the apparatus is worn;

means for regulating the fluid volume within said bladder means, whereby when the apparatus is worn the apparatus will substantially inhibit movement of the wrist joint in flexion and extension from a position wherein the lateral side of the individual's forearm and hand above and below the wrist joint, respectively, lie substantially in a common lateral plane.

16. Apparatus according to claim 15 wherein said inflatable bladder means includes a plurality of elongated chambers extending generally parallel to the forearm so as to extend above and below the wrist joint when the apparatus is worn, and means for securing said bladder means to said glove.

17. Apparatus according to claim 16 wherein said inflatable bladder means is secured relative to said glove such that substantially equal portions of said bladder means lie above and below a lateral centerline through the individual's wrist joint along the lateral side of the hand and forearm when the apparatus is worn.

18. Apparatus according to claim 16 wherein said bladder means has a width sufficient to extend to the heel side of an individual's hand when the apparatus is worn, at least one of said inflatable chambers extending generally parallel to the individual's forearm and above and below the wrist joint to extend along the heel side of the hand and corresponding side of the individual's forearm when the apparatus is worn such that said bladder means stabilizes the wrist joint in adduction.

19. Apparatus according to claim 15 wherein said inflatable bladder means includes a plurality of inflatable chambers extending generally parallel to the forearm and hand above and below the wrist joint when the apparatus is worn, said bladder means having upper and lower walls, one of said upper and lower walls of said bladder means including a material for restricting the expansion of said chambers upon inflation to increase the internal pressure within said chambers and their rigidity.

20. Apparatus according to claim 19 wherein one of said upper and lower walls of said bladder means has an elasticity greater than the other of said upper and lower walls.

21. Apparatus according to claim 15 wherein said inflatable bladder means includes a plurality of inflatable chambers extending generally parallel to the individual's forearm when the apparatus is worn, and said bladder means having passages providing open fluid communication between said chambers.

22. Apparatus according to claim 21 wherein said bladder means includes upper and lower walls formed of a heat-sealable material, said chambers being formed by seams extending parallel to said chambers and laterally spaced from one another, said seams including heat-sealed portions of said upper and lower walls.

23. Apparatus according to claim 22 wherein said bladder means includes a peripheral seam, said peripheral seam including heat-sealed portions of said upper and lower walls.

24. Apparatus according to claim 23 in which at least one of said upper and lower walls of said bladder means includes a material for restricting the volume of said chambers upon inflation thereof to increase the internal pressure within said chambers and their rigidity.

25. Apparatus according to claim 23 including spaced openings in at least one of said seams and peripheral seam.

26. Apparatus according to claim 15 in which said adjusting means includes first and second adjustable members mounted to said glove for securing said bladder means substantially taut, said first adjustable member being selectively adjustable to overlay said bladder means adjacent said leading edge thereof and said second adjustable member being adjustable to overlay and bladder means adjacent said rear edge thereof.

27. Apparatus according to claim 26 including means to secure said bladder means to said glove.

28. Apparatus according to claim 27 wherein said bladder means includes a plurality of generally parallel inflatable chambers and having upper and lower walls formed of a heat-sealable material, said chambers being formed by seams extending parallel to said chambers and laterally spaced from one another, said seams including heat-sealed portions of said upper and lower walls, and said bladder including a peripheral seam including heat-sealed portions of said upper and lower walls.

29. Apparatus according to claim 28 wherein said means for regulating the fluid volume includes a flexible inflator bulb means connected to said bladder said inflator bulb means including valve means for enabling inflation of said chambers in response to manual flexing thereof.

30. Apparatus according to claim 29 including a manually actuated deflating valve in communication with said chambers for deflating said chamber.

* * * * *